US009549870B2

(12) United States Patent
Shafieloo

(10) Patent No.: US 9,549,870 B2
(45) Date of Patent: Jan. 24, 2017

(54) SMART JOINT CARE

(71) Applicant: Iman Shafieloo, Waterloo (CA)

(72) Inventor: Iman Shafieloo, Waterloo (CA)

( * ) Notice: Subject to any disclaimer, the term of this patent is extended or adjusted under 35 U.S.C. 154(b) by 0 days.

(21) Appl. No.: 14/881,420

(22) Filed: Oct. 13, 2015

(65) Prior Publication Data

US 2016/0030281 A1 Feb. 4, 2016

Related U.S. Application Data

(63) Continuation-in-part of application No. 13/902,917, filed on May 27, 2013.

(51) Int. Cl.
*A61H 23/02* (2006.01)

(52) U.S. Cl.
CPC ..... *A61H 23/0263* (2013.01); *A61H 23/0245* (2013.01); *A61H 2201/164* (2013.01); *A61H 2201/1604* (2013.01); *A61H 2201/165* (2013.01); *A61H 2201/1623* (2013.01); *A61H 2201/1635* (2013.01); *A61H 2201/501* (2013.01); *A61H 2201/5002* (2013.01); *A61H 2201/5005* (2013.01); *A61H 2201/5015* (2013.01); *A61H 2201/5035* (2013.01); *A61H 2201/5038* (2013.01); *A61H 2201/5058* (2013.01); *A61H 2201/5084* (2013.01); *A61H 2201/5097* (2013.01); *A61H 2205/02* (2013.01); *A61H 2205/024* (2013.01); *A61H 2205/025* (2013.01); *A61H 2205/028* (2013.01); *A61H 2205/065* (2013.01); *A61H 2205/102* (2013.01); *A61H 2205/12* (2013.01); *A61H 2230/50* (2013.01)

(58) Field of Classification Search
CPC .... A61H 23/00; A61H 23/003; A61H 23/006; A61H 23/0245; A61H 23/0263; A61H 2201/165; A61H 2201/5002; A61H 2201/5005; A61H 2201/5007; A61H 2201/501; A61H 2201/5012; A61H 2201/5015; A61H 2201/5038; A61H 2201/5071; A61H 2201/5082; A61H 2201/5097
See application file for complete search history.

(56) References Cited

U.S. PATENT DOCUMENTS 4,052,981 A * 10/1977 Bachmann ..... A61H 23/0263 601/134
5,913,838 A * 6/1999 Reilly ..... A61H 23/02 36/136
2003/0167027 A1* 9/2003 Estrella ..... A61H 7/006 601/136

(Continued)

*Primary Examiner* — LaToya M Louis
(74) *Attorney, Agent, or Firm* — Nasser Ashgriz; VIPatent Inc

(57) ABSTRACT

A system that applies vibration to a desired region of a human body including a plurality of vibratory stimulators installed in a flexible material; a programmable control unit (PCU) connected to each said vibratory stimulator a plurality of sensors to collect biofeedback data; a set of programs for the operation of the PCU; a biomechanical database stored in a computer and being populated by the biomechanical data collected by the sensors after application of each said predefined pattern of vibration; and an algorithm to analyze and rank said patterns of vibration according to a ranking factor, wherein a user can choose a pattern of vibration that has a higher ranking factor.

18 Claims, 25 Drawing Sheets

(56) References Cited

U.S. PATENT DOCUMENTS

| | | | | |
|---|---|---|---|---|
| 2004/0202011 | A1* | 10/2004 | Lee | H05B 37/0209 307/116 |
| 2005/0113723 | A1* | 5/2005 | Ueyama | A61H 15/0078 601/15 |
| 2005/0137503 | A1* | 6/2005 | Hori | A61B 5/0533 601/99 |
| 2007/0255187 | A1* | 11/2007 | Branch | A61F 7/02 601/15 |
| 2010/0249637 | A1* | 9/2010 | Walter | A61H 23/02 600/544 |
| 2011/0054345 | A1* | 3/2011 | Nagatani | A61B 5/05 600/552 |
| 2011/0137217 | A1* | 6/2011 | Shinnick | A61M 21/00 601/89 |
| 2014/0316309 | A1* | 10/2014 | Seo | A61H 23/02 601/46 |

* cited by examiner (a)

(b)

SMART JOINT CARE

RELATED APPLICATION

This application repeats a substantial portion of prior application Ser. No. 13/902,917, filed May 27, 2013, and adds or claims additional disclosure not presented in the prior application. Since this application names the inventor or at least one joint inventor named in the prior application, it may constitute a continuation-in-part of the prior application.

FIELD OF THE INVENTION

The present invention relates to a programmable sensory and stimulatory network or mesh system for physiological stimulation including but not limited to the nervous system.

BACKGROUND OF THE INVENTION

User feedback is an important part of pain and edema management. As individuals vary in the tolerance for, and the sensation of pain and edema, it is important to tailor treatments to the individual. Joint and muscle pain and edema can be caused by multivariate factors. Swelling, strains, or breaks in tissues can cause severe pain and edema lasting for longer periods. Additionally, delayed onset muscle soreness, and fatigue pain and edema from exercise and over use respectively can cause pain and edema in discomfort that may limit activities of daily living. Chronic pain and edema resulting from ailments such as arthritis, fibromyalgia and others can affect the daily living activities and the comfort of afflicted individuals.

Currently, there are a number of methods for pain and edema relief. Pharmaceutical methods of treating pain and edema with analgesics are effective for acute pain and edema; however, they are not as effective for chronic pain and edema management because of side effects caused by their prolonged use.

The more conventional non-pharmaceutical method of relieving pain and edema is through massage and vibration therapies, as well as acupressure. Massage therapy is the art of manipulation of muscles and connective tissues to enhance function and aid in the healing process. Massage therapy relives pain and edema from musculoskeletal injuries, rehabilitates sports injuries and other causes of pain and edema. Furthermore, massage therapy has been shown to enhance relaxation, and reduce stress, anxiety, and subclinical depression. It is also shown to temporarily reduce blood pressure, and heart rate.

Acupressure involves applying physical pressure against specific parts of the body to achieve some degree of treatment or pain and edema relief. However, these devices require an attending therapist during treatment to be effective.

Electric stimulation is another method to relieve pain and edema, in which pulses of electric energy at low current levels are applied to the parts of the body that emanate pain and edema. To apply an electric stimulus the prior art teaches the use of TENS (Transcutaneous Electrical Nerve Stimulation) devices. TENS devices deliver electric bursts through the skin to cutaneous (surface) and afferent (deep) nerves to control pain and edema. TENS are able to stimulate a specific nerve to ease a specific point of pain and edema.

Another method of pain and edema relief is through the use of repetitive transcranial magnetic stimulation (TMS) to stimulate specific groups on neurons in the cortex. The repetitive transcranial magnetic stimulation (TMS) is a method of generating a weak magnetic field and electric currents in brain cortex neurons using the principle of an electromagnetic induction by instantaneously passing a current through a coil and non-invasively stimulating brain cortex neurons. TMS is delivered by passing a brief (200 microsecond), strong (10,000 volts, 6,000 amps) electrical current through a coil of wire (a TMS stimulator) placed adjacent to the head. The passage of electrical current induces a strong (2 Tesla) magnetic field which, in turn, induces electrical currents in nearby tissues. In the case of nerve cells, if the induced current is sufficiently intense and properly oriented, it will result in synchronized depolarization of a localized group of neurons.

SUMMARY OF THE INVENTION

Pain and edema is a subjective matter and as such it is measured by using self-reporting pain and edema scoring systems typically involving a scale from 0 to 10. Since an individual perception of pain and edema can vary one person's 7 out of 10 can be equal to another's 3 out of 10 although both individuals have the same physiological symptoms and impairment including limited range of motion, swelling and stiffness.

The present invention attempts to unify the varieties in pain and edema perception for each individual by incorporating measurements such as self reports, facial expressions, medical imaging, in vivo angles of movements, orientation, temperature, swelling etc. which are unique to each individual regardless of their health, conditions and levels of pain and edema. By collecting and analysing these data over time, the effectiveness of the treatments for each individual depending on their conditions can be measured.

The present invention comprises a stimulatory and sensory wearable mesh system e.g., vibratory that is connected to a server. Information about pain and edema including, but not limited to, the range of motion that is uploaded via secured protocols to secured server(s). The data is then analyzed and compared with experiences of other users which have resulted in the change in their conditions, some of which are: decrease in pain and swelling. The user is then recommended a treatment that has previously aided, for example, in decreasing pain and edema by allowing more range of motion.

Pain and edema perception and impairment can vary within individuals depending on a number of circumstances. For example, an individual may experience pain and edema of 0 out of 10 on a pain scale in the morning, and have a range of movement in a knee joint of x degrees and acceleration of $y=m/s^2$. In the evening, the same individual can have pain and edema of 4 out of 10 on the scale, x' degrees range of motion and $y'=m/s^2$ acceleration. The change in range of motion and acceleration correlates and quantifies the pain and edema based on measurable numbers. The system proposed here offers a solution for pain and edema sufferers, and could be used to measure effectiveness of the recommended solutions for pain and edema management, including pharmaceutical and non-pharmaceutical solutions.

The present invention collects data such as range of movement, acceleration, swelling, score of pain and edema, and patients' conditions. The data are then logged in a secure server. The present invention uses data mining algorithms that are constantly running on the data collected from the individuals. Solutions for specific pain and edema problems will be recommended based on users' usage of treatments.

In the case of the present invention, the frequency, intensity, amplitude, duty cycles, and patterns are recommended according to change in patients' condition. In other cases, other variables related to the specific solutions—such as temperature and circumference of the joint—will be measured and incorporated in the final recommendations.

Based on the improvements of patient's range of motion, pain and edema score, and other biofeedback measurements, the artificial intelligence (Al based smart orthopaedics) learns over time what treatment is more effective. Hence, the present invention will be able to provide the best suited recommendations to individuals. Data will be logged on NTI server for mining purposes and decision making leading to a treatment engine.

The present invention relates to a programmable topical vibratory and sensory mesh for programmable sensory vibratory neural stimulation (VSNS) at the range of 80-220 Hz vibration. Some of these vibratory elements and sources include: weighted dc vibration motors, linear resonant actuators, piezoelectricity devices etc. The present invention applies a programmable patterned vibration to a desired region of the human body. The present invention comprises of the following: a grid of multiple vibratory stimulators, sensors installed throughout a resilient or flexible material, a programmable control unit (PCU), and a user interface in form of software on PC to control the vibration of each of the vibrators. The latter may be installed in a hand held device or an android phone/iPhone for ease of use, and wired or wirelessly connected to the vibratory or sensory mesh.

Described herein are methods, devices and systems for controlling the vibration of plurality of vibrators located at pain and edema generating regions of a body. The vibration may be performed at fixed/mixed fixed, random intervals, and/or at different pulse rates. In general, the present invention described here includes methods of stimulating from multiple vibrators so that total energy of vibration may resonantly stimulate and alter firing of neurons in the region of pain and edema hence, resulting in neuro-modulation. The present invention further includes controlling the timing, rate, and power of each stimulator in an array of vibrators to achieve effective pain and edema relief.

A novel aspect of the present invention is that it provides a means for both subjective and objective quantification of pain and edema. Moreover, various factors can influence a person's perception of pain and edema making each individual's pain and edema perception unique. The present invention recognizes that the perception for similar injuries or conditions can vary highly between individuals and can thus allow for a fully customizable treatment that is based on data gathered objectively from a large variety of individuals. User's scores for pain are combined with objective measurement from a combination of sensors to gain an insight into a user's perception of pain and edema. The present invention has the ability to tailor specific individual treatment from subjective and objective measurements of pain and edema. While symptoms and objective measures of pain and edema such as the data collected from the sensors of the present invention may be similar across individual their perception of pain and edema can be quite different or vice-versa. The present invention takes into account both measures so as to provide a custom treatment to the individual. For example, a user may choose to specific treatments that target specifically their subjective experience of pain and edema whereas another user may opt to focus on increasing movement in a joint so as to be able to perform certain tasks.

The aforementioned objectives of the present invention are attained by a programmable vibratory and sensory mesh (for programmable sensory vibratory neural stimulation), and having a plurality of vibration elements, sensors, and several accessories. Other objectives, advantages and novel features of the present invention will become readily apparent from the following drawings and detailed description of preferred embodiments.

BRIEF DESCRIPTION OF THE DRAWINGS

Embodiments herein will hereinafter be described in conjunction with the appended drawings provided, to illustrate and not to limit the scope of the claims, wherein like designations denote like elements, and in which:

FIG. 1 (*b*) shows human central nervous system;

DETAILED DESCRIPTION OF PREFERRED EMBODIMENTS

The present invention is a programmable vibratory Sensory neural stimulator (PVSNS) comprising of plurality of vibratory stimulators compactly installed in a flexible material to be worn or attached to a part of a body. The frequency, amplitude, intensity, duty cycle, and the operation time of each vibrator are controlled individually. Therefore, any specific pattern of vibration can be generated.

Figure 1:
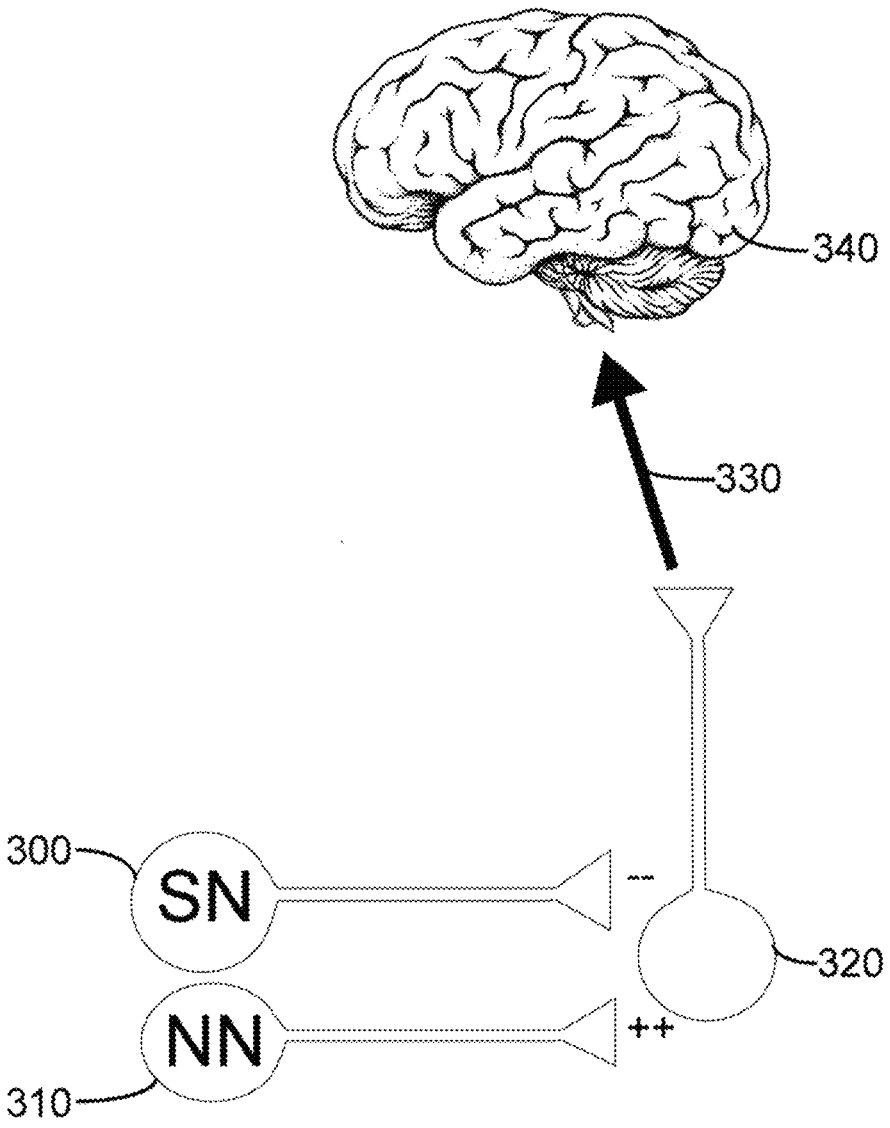
FIG. 1 Prior art
FIG. 1 (*a*) shows simplified conceptual diagram of the gate theory model of pain and edema perception.
Figure 1:
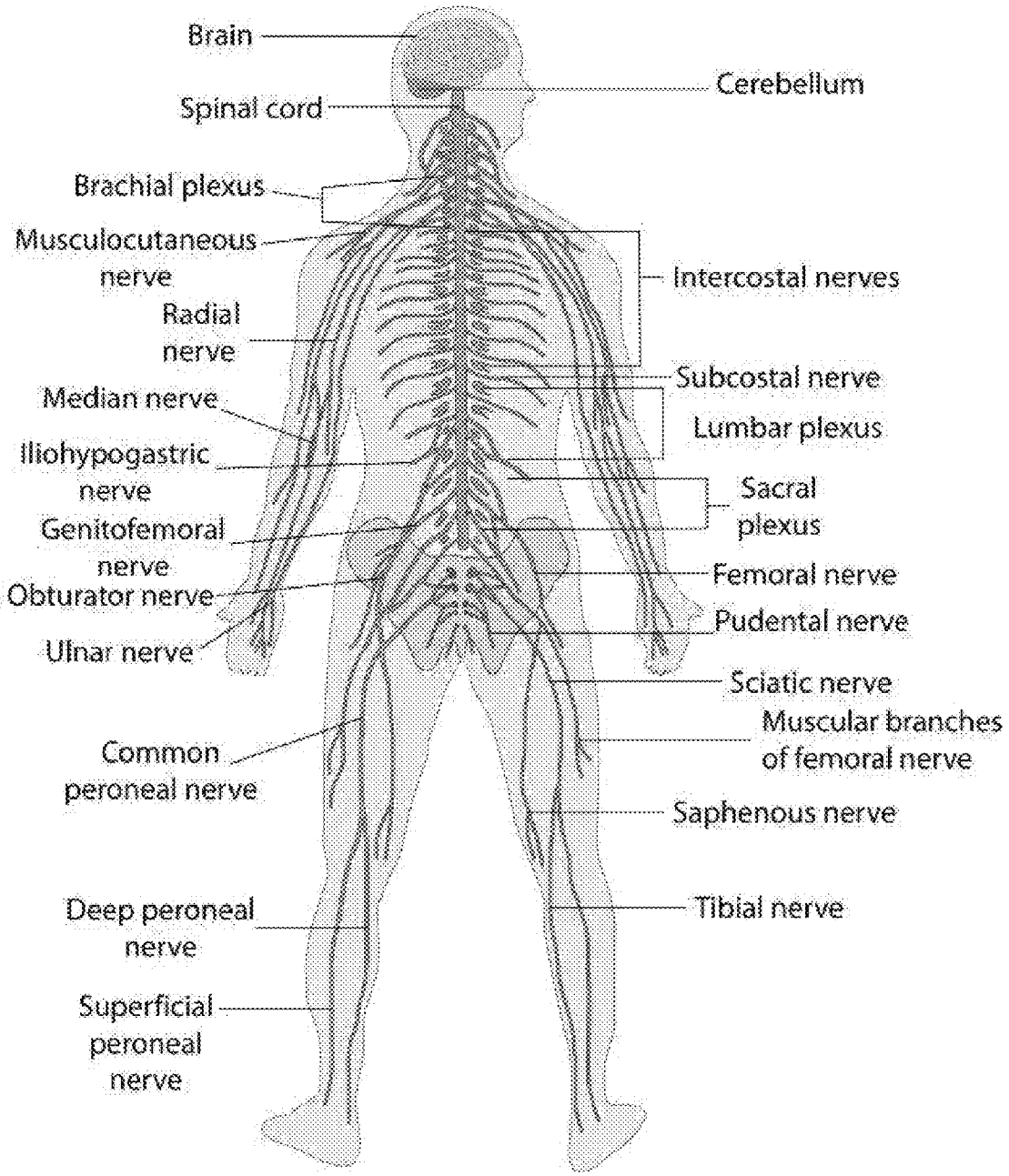
FIG. 1 Prior art

The prevailing theory of pain and edema perception is gate control theory and is herein illustrated in FIG. 1 (*a*). During a pain and edema inducing event peripheral nociceptive or pain and edema, sensing sensory fibers 300 receive and send the signal to an interneuron 320, which sends the signal through central nervous system 330 to the brain 340. Pain and edema is carried by two different types of fibres: the first being fast, which carry a sharp pain and edema sensation that does not last very long; the second type of fibres are slower that result in a dull prolonged pain and edema sensation. According to gate control theory, non-nociceptive neurons 310 emanating from the same regions where the pain and edema is sensed are able to carry a faster signal to the interneuron 320 and inhibit its firing. Thus, rubbing, vibration, or massage in the same region where the pain and edema is occurring has an inhibitory effect on the pain and edema.

The present invention takes advantage of current knowledge of pain and edema perception. Accordingly, it is an objective of the present invention to inhibit pain and edema by use of vibratory motion or massage. Placing the vibratory pad portion of the present invention can help alleviate pain and edema symptoms. The present invention can be adapted and placed on a head, knee, ankle, neck, and spine—according to the human physiology and location of nerves in human body as shown in FIG. 1 (*b*) or otherwise, as will be further shown. When applicable, the present invention records the range of motion of a joint or body part, how fast the joint or body part is moving and the user's self-reported pain and edema score.

Figure 2:
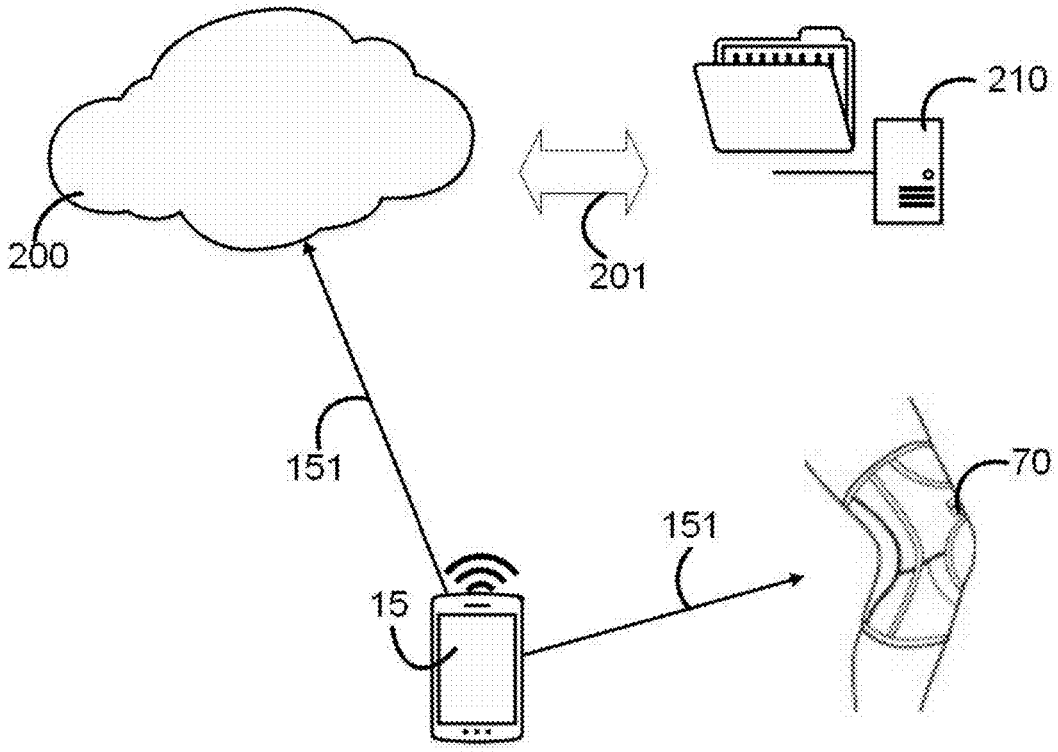
FIG. 2 shows how the various elements of the present invention are connected.

Typical use of the present invention involves a user option selecting a treatment program for the brace 70 using an app on a smart phone 15, as is shown in FIG. 2. The user can select from a self-designed treatment or from currently available treatments that are located in cloud storage 200. A mobile device 15 can communicate 151 with the cloud 200 where the user's personal treatment plan will be stored. The cloud 200 communicates 201 with the servers 210. The servers 210 contain algorithms, which mine all treatment data stored in the cloud 200 and compares objectively gather data including but not limited to range of motion, speed, temperature and pressure along with self-reported pain and edema scores. As such, the algorithms are capable of advising users of the best possible treatment for the reported pain and edema.

Figure 3:
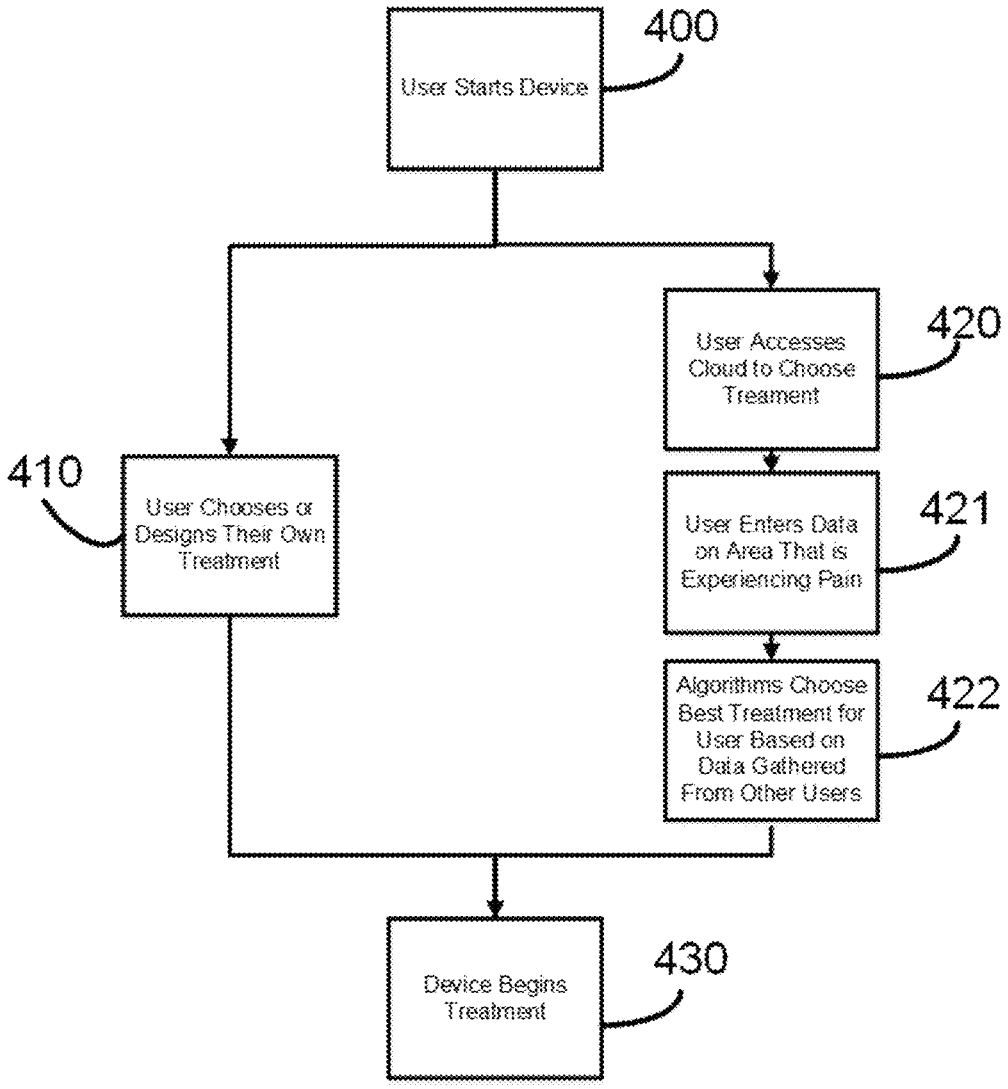
FIG. 3 shows the process by which user selects a treatment program using the software of the present invention.

The software operation of the present invention works by having the user start the device 400 as shown in FIG. 3. The user can either design their own program 410 or access the cloud 420 to select a program. Additionally, upon turning on the device 400, a user will immediately receive treatments of preloaded programs. If the user decides to select a program from the cloud, they would enter 421 the region and the type of pain and edema they are experiencing. Based on that information, algorithms in the servers suggest treatment programs 422. Once a program is selected, the user can then begin treatment 430.

Once the program selection is complete, the present invention proceeds to stimulate the user with the aid of vibratory motors located at specific locations on the brace 70, matching the nerves path in body joints FIG. 1-*b*. The placement of the motors can vary depending on the type of brace and the body part it is intended for. The treatment program can be self-designed by a user—in order to target specific areas of pain and edema, or it can be selected from programs that have been previously uploaded by other users or by the manufacturer.

Sensors are present at specific locations in the different embodiments of the present invention. The type of sensor will depend on the body part where the present invention is attached. Accelerometers are located on joints such as wrists, knees, ankles etc. An array of pressure sensors is used to detect swelling on joints and body parts. Temperature sensors are used to detect the presence of inflammation, which is correlated with an increase in temperature and/or swelling, and can often accompany particular types of pain and edema.

The sensors provide an objective measurement of users' pain and edema. The users can rate their pain and edema perception after the treatment and the present invention can also record the movement and speed of movement for the joint. The present invention can obtain an objective measurement of the effectiveness of a particular treatment, and then combine that with the individual's experience of the pain and edema.

Furthermore, a novel aspect of the present invention is that it is capable of data mining treatment methods of particular joints or other areas of pain and edema. Again referring to FIG. 2 and FIG. 3, it is showing an example of a user, who is experiencing knee pain and/or edema, being able to select a treatment for that particular joint. The present invention contains a database of treatments uploaded by other users and determines the appropriate treatment base on the objective data, such as movement ability. The present invention is capable of tracking the frequency, amplitude, intensity, duty cycles, and usage patterns of the brace 70. The software algorithm of the present invention continuously monitors which treatments are most effective for each condition by comparing the values obtained from pain and edema scores and recorded data from the sensors of the devices.

The present invention can be used on a number of regions of the body and joints. Additionally, for pain such as headache, or pain on other parts of the body where mobility and motion information may be difficult to obtain or may not accurately reflect pain and edema, a self-reported score can be used.

Figure 4:
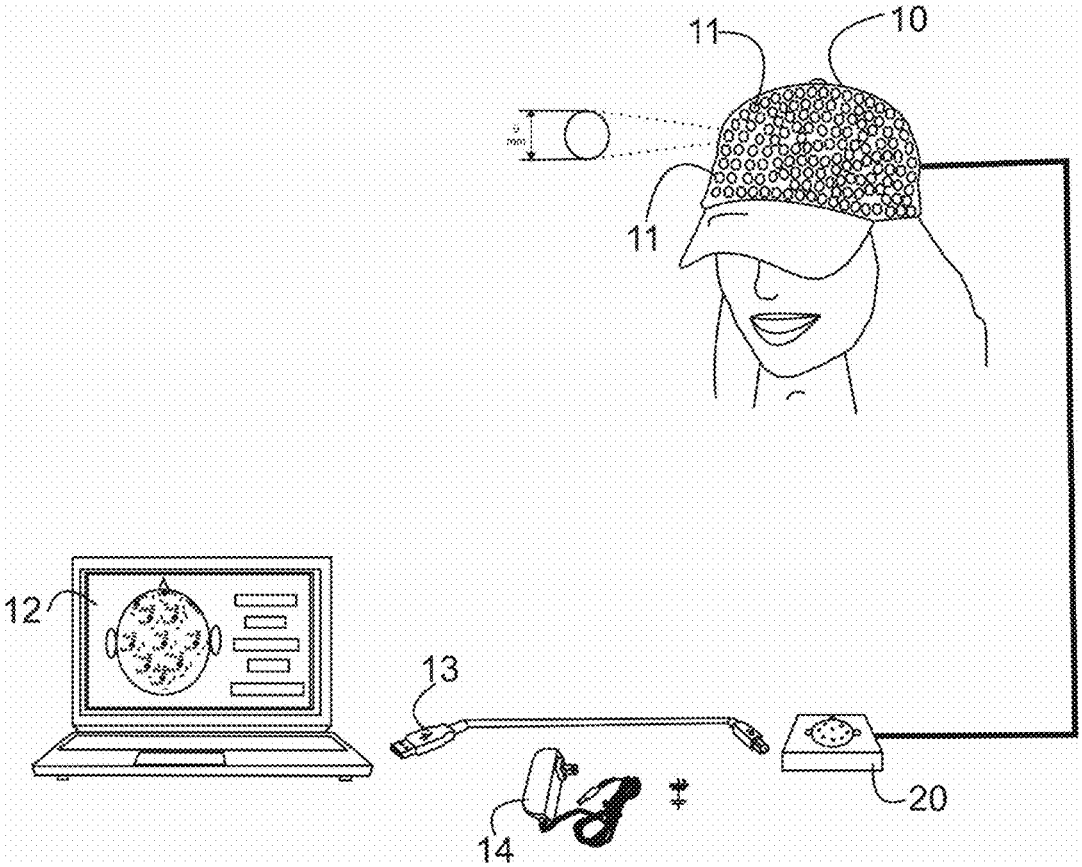
FIG. 4 shows the programmable vibratory sensory neural stimulation (PVSNS) in the form of a cap with possible power options (USB, battery, and power adaptor)

One embodiment of the present invention is a cap; FIG. 4 shows a cap 10 with a built in mesh of vibratory stimulators and sensors on the inside surface of the cap 10, a Programmable Control Unit (PCU) 20 and a user interface in the form of a software on PC 12, hand held device or android phone/iPhone as well as optional wireless unit. FIG. 4 shows the present invention with possible power options (USB, battery, and power adaptor 14). The maximum number of vibration nodes could be defined by the surface area of each vibrator. Moreover, the locations of the wearable vibrators in the wraps are defined based on nerve path in the affected area of the joints.

Figure 5:
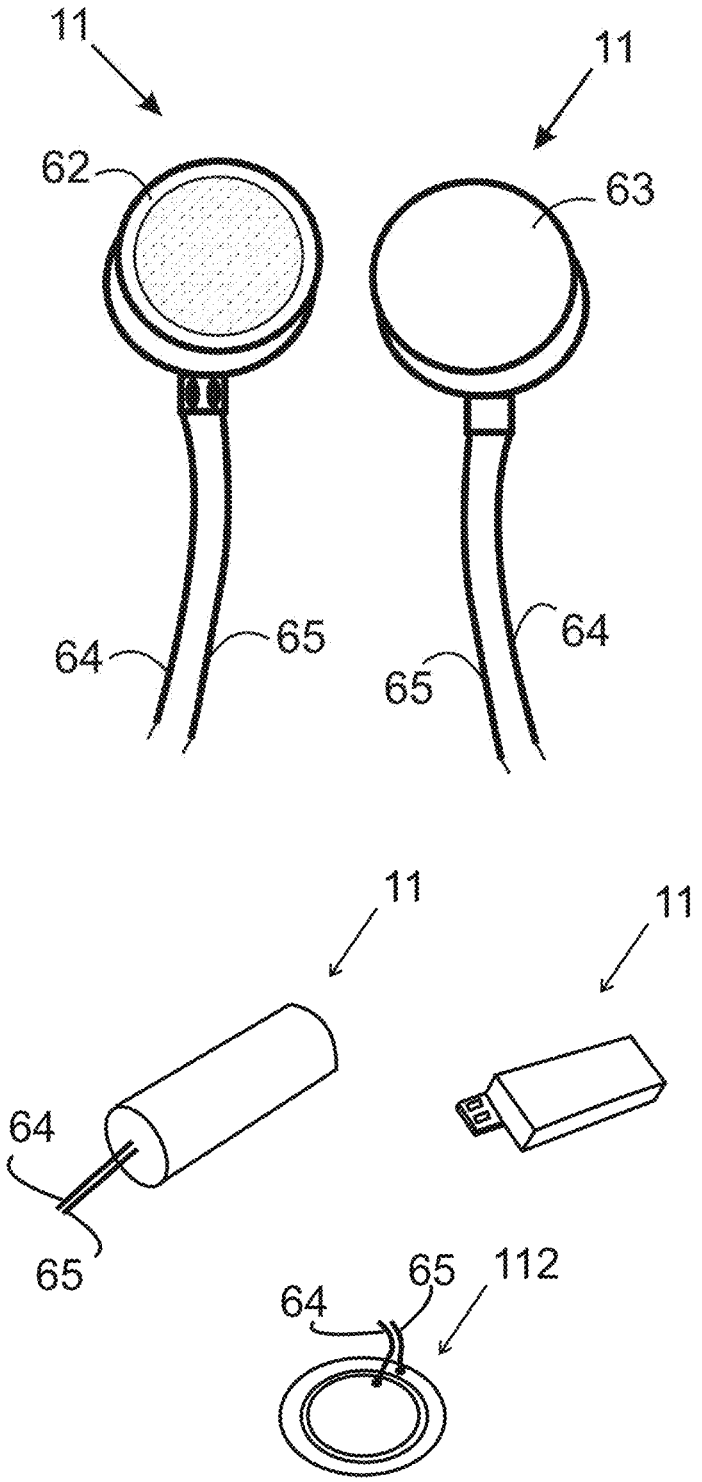
FIG. 5 shows different vibratory stimulators including: coin vibration DC motors, linear resonant actuators, encapsulated (overmoldable) vibration motors, and piezoelectric vibration sensors.

FIG. 5 shows different types of vibratory stimulators used in the present devices. The vibrator 11 comprising of a cylindrical body having two substantially flat surfaces 62, 63. The vibrator motor 11 having wires 64 and 65 to connect to the system grid. There are a variety of vibratory stimulators. One of which includes a motor where the rotor has an eccentric structure, which causes circumferential direction of the rotation. Such small vibrators are commonly used in mobile phones and are known to professionals in this field. One important character of the vibrators in the present invention is that their amplitude has to be small enough to not present a pressure sensation. This type of vibrator is distinguished from the larger amplitude vibrators used for massage and muscle relaxation.

Again referring to FIG. 5, coin vibration DC motors 11, linear resonant actuators 11, encapsulated (overmoldable) vibration motors 11, and piezoelectric vibration sensors 112 that used in the present invention are shown.

Figure 6:
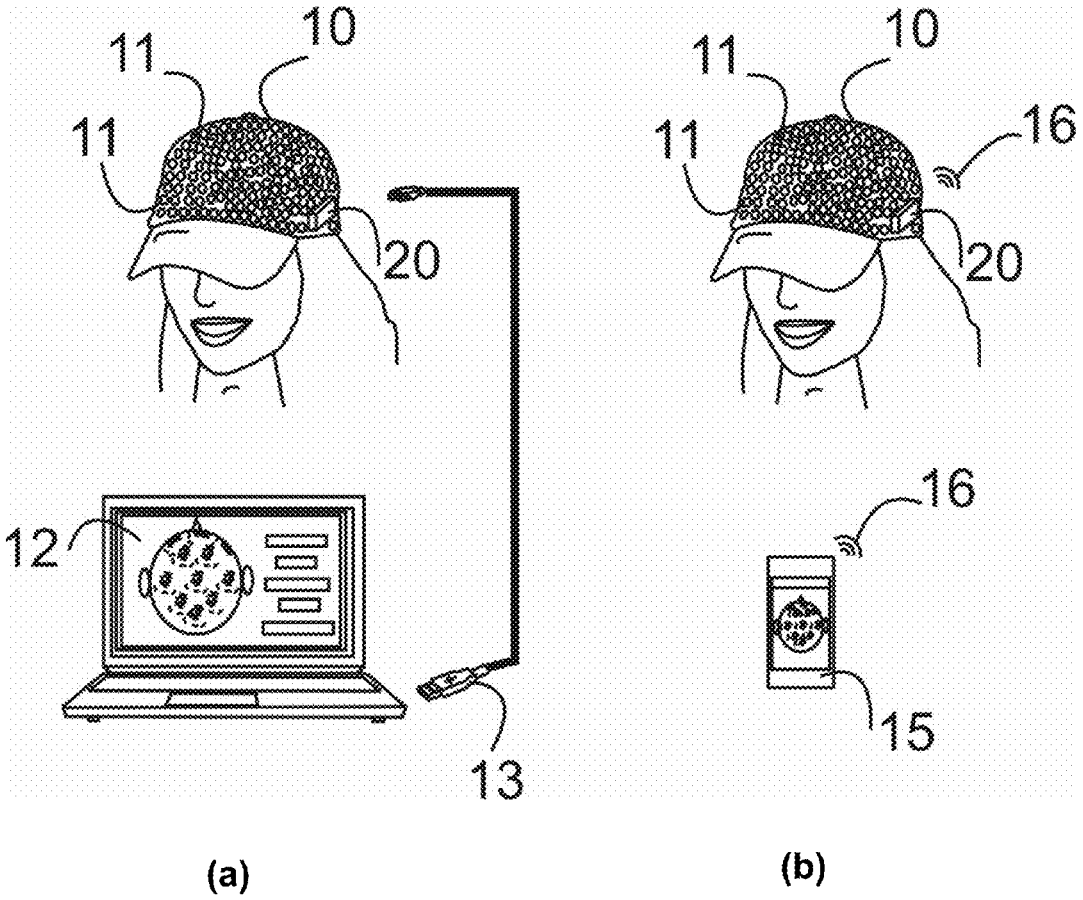
FIG. 6 shows (a) cable connection to computer, (b) wireless connection to computer or handheld device like mobile.

FIG. 6 shows the mesh installed inside a cap based on the brain's anatomical structure. A user interface in the form of software on a PC 12, a hand held device 15 or an android phone/iPhone 15 are shown in FIGS. 6(*a*) and 6(*b*). The box 20 attached to the cap 10 represents the PCU. Miniature DC motors 11 (vibration disks 11) are installed inside the cap in an array form creating a mesh of vibration and sensor nodes. The PCU 20 is connected to a PC 12 by USB connection 13 or through a mobile phone 15 with Wi-Fi or Bluetooth connection 16. Acceleration, duration of vibration, intensity and the frequency of vibration for each node is controlled by the PCU 20.

Figure 7:
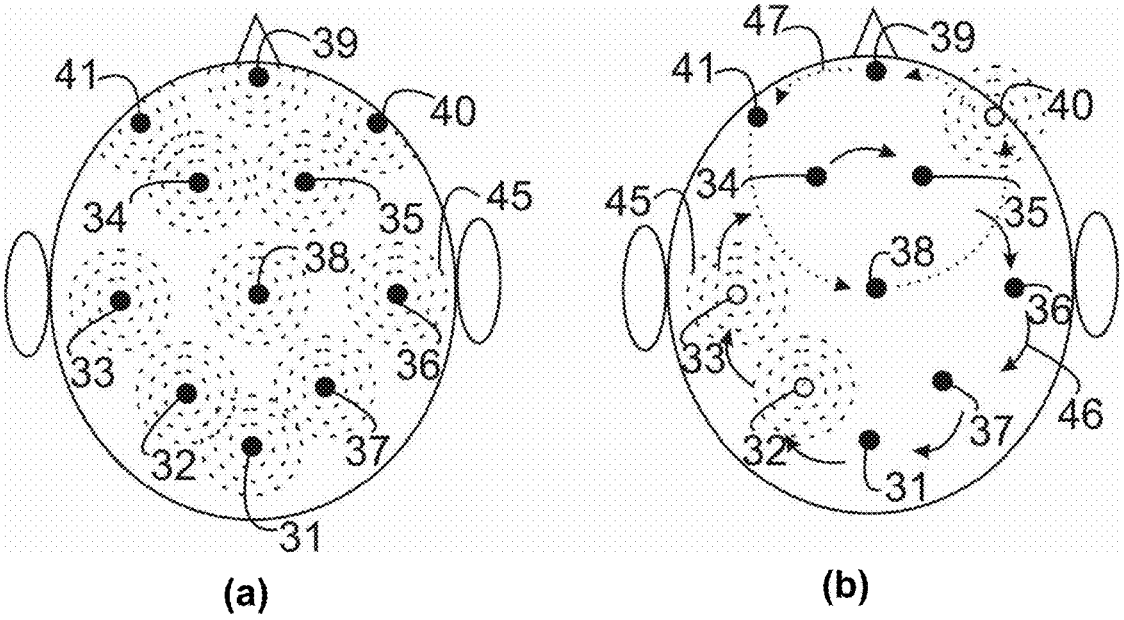
FIG. 7 shows the vibrators and examples of vibration patters: (a) vibration pattern for all vibrators, (b) a user defined pattern of vibration.

According to FIG. 7, different patterns of vibration can be provided to a user. The PCU controls vibration of each of the vibrator 31-41. All vibrators 31-41 can vibrate simultaneously or vibrate with a specific pattern. The dot lines 45 in FIG. 7 represent vibration patterns of each vibrator 31-41 and arrows 46 represent the direction of the movement of the vibration for the first group of vibrators 31-37 and arrows 47 represent the direction of the movement of the vibration for the second group of vibrators 38-41.

The user interface used in the present invention is a software/program, which allows a user to program the mesh with the desired patterns. The user interface may include a Graphic User Interface (GUI) on a PC, a hand held device or on an android phone/iPhone. The user program could be uploaded into the PCU via USB cable or wireless (Bluetooth, etc.). Upon the program upload, the cap will start stimulating the skull with the vibration pattern defined by the user's program. Visually the pattern is seen either via an LED mesh or in the software by changing the colors of the vibrating nodes in the GUI as shown in FIG. 8.

Figure 8:
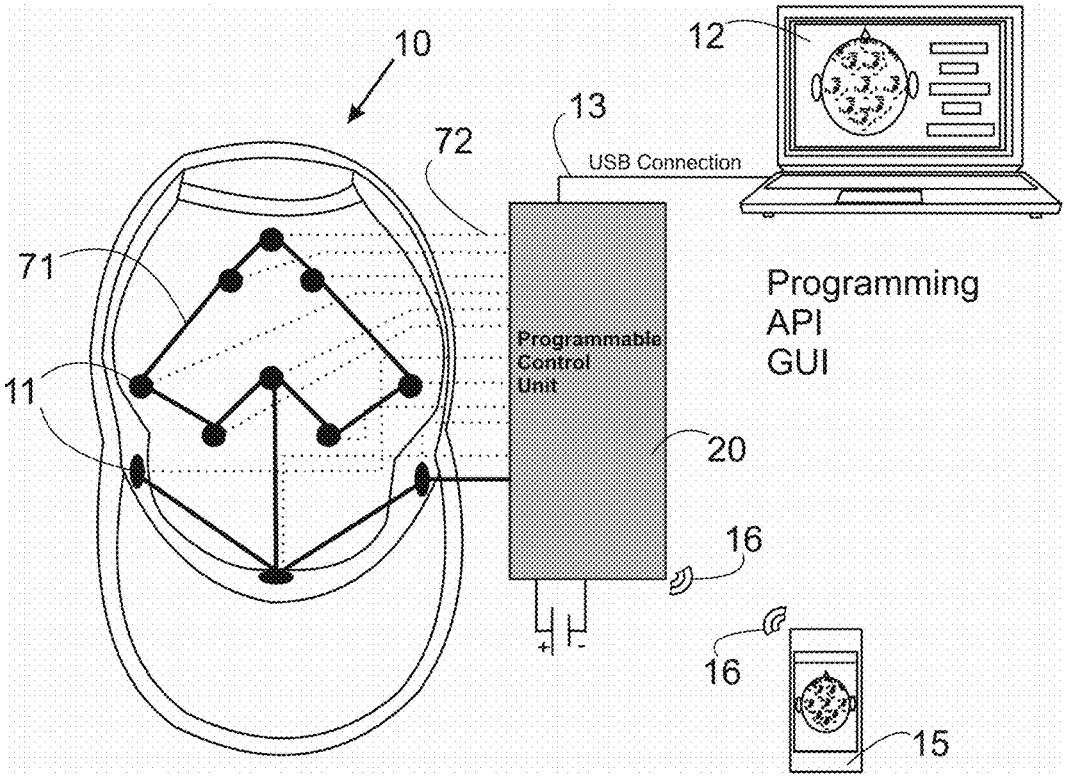
FIG. 8 shows the electrical connection for the vibratory and sensory mesh that is laid down inside a cap.

The wiring of the vibrator motors 11 for programming of the PVSNS is also shown in FIG. 8. The solid line 71 represents negative wire and the dot line 72 represents the positive wire. As is shown in FIG. 5, each vibrator 11 connected to each other with solid line 71 (negative wire) and all dotted lines 72 (positive wire) go to the PCU 20. With this kind of wiring the programming of each individual vibrator 11 is possible with helps of PCU 20 that programmed by a PC 12 through a USB connection 13 or by a handheld mobile phone 15 through Wireless connections 16.

The wiring for all embodiments of the present invention is the same as shown the FIG. 8. Vibrator motors 11 are individually controlled and are connected to their own input pulse sources. The vibration motors are connected together for grounding.

Figure 9:
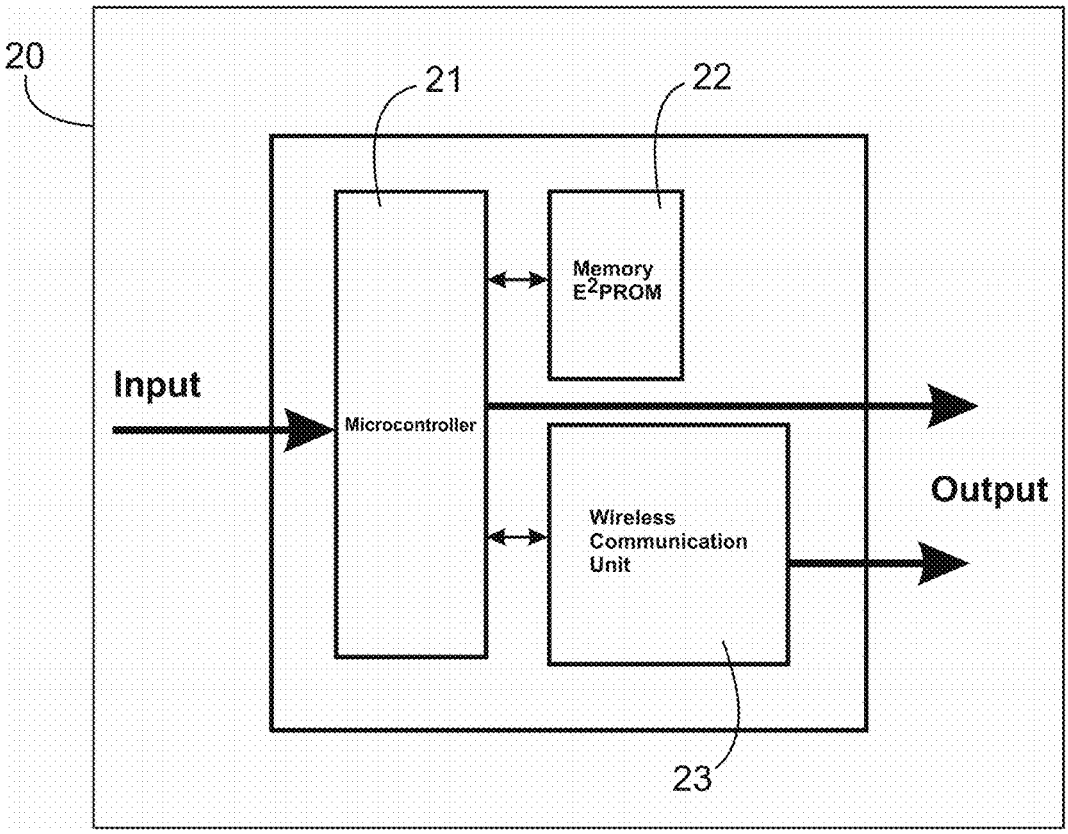
FIG. 9 shows schematic flow chart for a Programmable Control Unit (PCU)

Schematic of the PCU 20 is shown in FIG. 9. The pattern of vibration is also generated and controlled by program(s) uploaded to the PCU 20 by the user. All necessary input data could go to Microcontroller 21. Microcontroller 21 is responsible for gathering data of all vibrators and analyzes data and sends the required commands to the vibrators.

Electrically Erasable Programmable Read-Only Memory (EEPROM) 22 is also utilized in the PCU 20 to store information such as device configuration. EEPROM is a type of non-volatile memory used in computers and other electronic devices to store small amounts of data that must be saved when power is removed. Wireless communication unit such as Bluetooth Low Energy 23 is also designed in PCU 20 to communicate with computer or mobile device.

Figure 10:
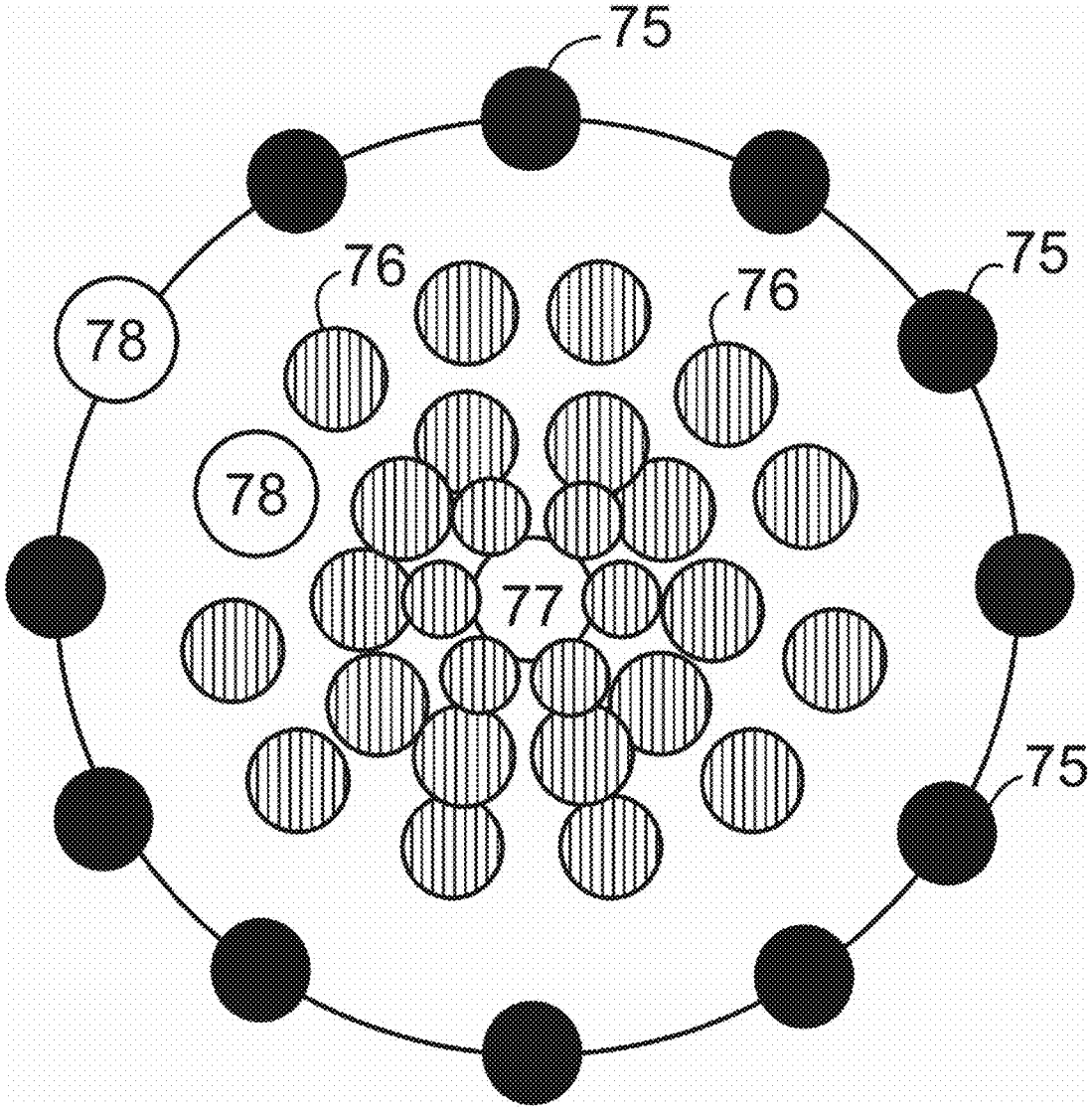
FIG. 10 shows a pre-programmed pattern designed to apply to a pain and edema region to relieve pain and edema.

When the device is worn by the user, the vibrators apply a vibration pattern on the scalp or other body parts. FIG. 10 illustrates a pre-programmed pattern designed to relieve pain and edema. Each circle in FIG. 10 represents a vibrator motor. In this pattern, the high intensity vibratory stimulation starts from the "no pain and edema" shown with solid vibrators 75, with no vibration or minimized vibration at the "center of the pain and edema" which is shown with circle 77. Over certain period of time (duration of treatment) suitable to the recipient's level of pain and edema and comfort, vibration increases in circular wave motions towards the center, and eventually a maximum intensity vibratory stimulation is applied at the center of the pain and edema (circle 77). For areas such as the knee, elbow, ankle or other similar joints, data about movement range, and movement speed are collected, and the user is asked to report a pain/edema-score after the treatment.

One of the objectives of the present invention is to identify specific pattern that best suit a particular patient; the treatment can then stimulate the pain and swelling area gently—according to the patient's condition. A user can enter an initial self-reported pain and edema score, and choose to use a massage program for the specific type of pain and edema, along with the area in which they are experiencing that discomfort. The present invention will connect to the cloud based servers 200 and a specific program will be selected for them. The massage program is selected by an algorithm that perpetually review, rank, and sort massage programs for each body part designed by users.

The manner in which a user is able to specify the type of treatment for s/he is illustrated in FIG. 3. Usage begins with the user installing the device on the body part experiencing pain and edema. Once the device is on, the user can enter the pain/edema score before the actual treatment, and the various sensors of the device will be able to detect parameters such as swelling, speed and range of movement. If this is the first time the device is being used, the user can select from several existing patterns via a smart-phone or use patterns that are pre-programmed on the device. The treatment program will then be run by the present invention. Once the session is done, the sensors of the present invention will take readings from the sensors, measuring the parameters as before. The user will also then enter their pain/edema score for the second time. After use, the user can observe the differences between their scores and the measurements form the sensors. Since the user is able to view both objective measurements of the affected body part and their own subjective score, they are able to then tailor their treatment towards improving the function of the desired body part, improving their pain and edema score, or do a combination of both. Thus the present invention is able to provide an objective measurement of the condition along with the subjective perception of the condition. Through accessing and recording both measurements, the present invention aims to provide a unique and personalised treatment based on the user's requirements.

Referring again to FIG. 10, for each specific part in which the present invention is used, users can define a "no pain and edema" zone 75 and a "center of pain and edema" circle 77 by putting pressure on those areas to be picked up by pressure sensors 78 and define them via the interface/app/software, which is working in tandem with the mesh to apply the vibration patterns. The central vibrators 76 which are located in between the center area (circle 77) and outer area (zone 75) and are programmed to apply smooth vibratory stimulation to the pain and edema site.

Figure 11:
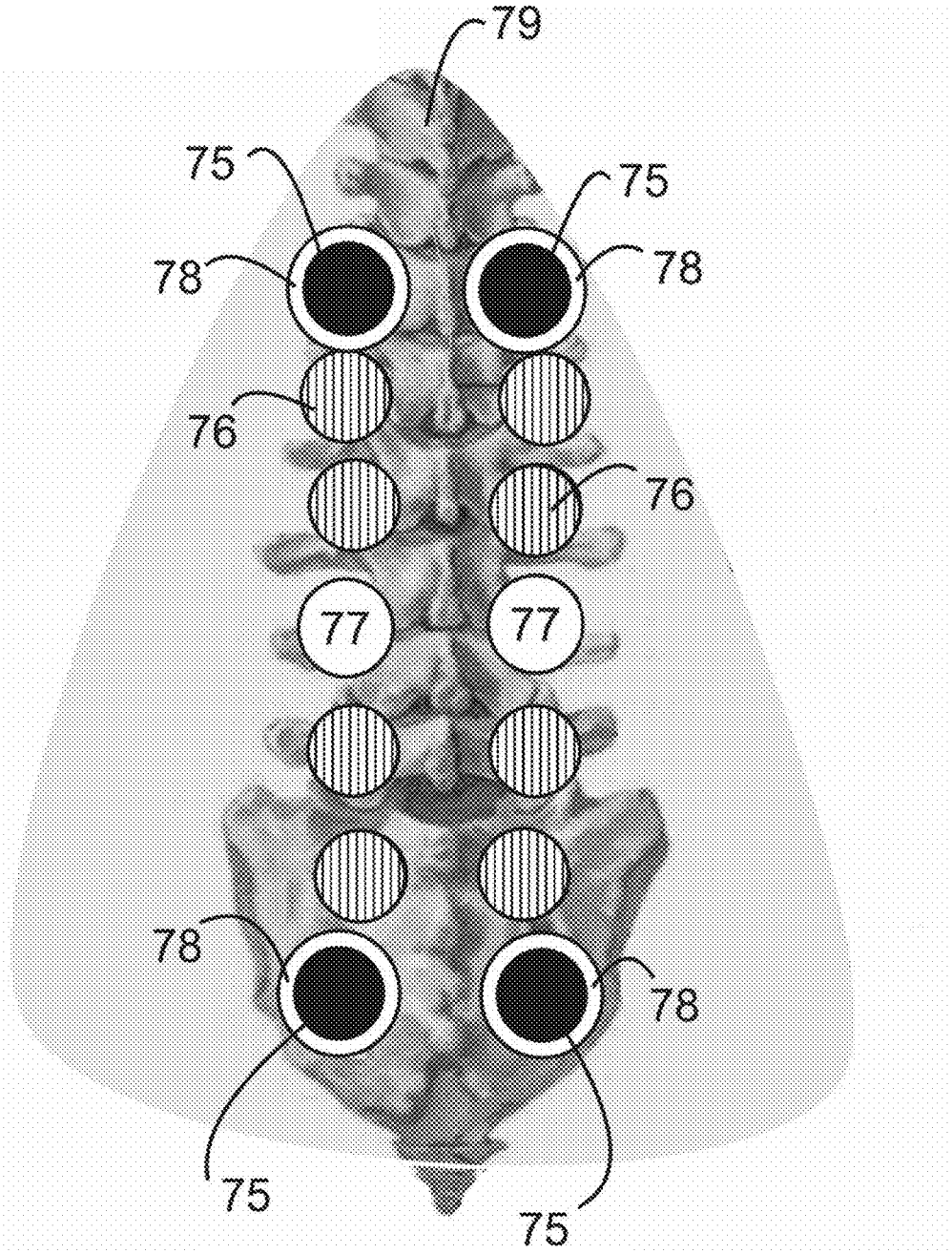
FIG. 11 shows back pain and edema patch having a PVSNS system with a pre-programmed vibration pattern.

The same concept is applied to other forms of garments and patches including a patch for the back pain. FIG. 11 shows a pre-programmed pattern to be used with the present invention on the spinal column 79. Each circle represents a vibrator motor. Patient can define the "no pain and edema" area 75 and the center of pain and edema 77 by putting pressure on those areas to be picked up by pressure sensors 78 or graphically via GUI in the mobile app or PC, and define their vibration characteristics.

Figure 12:
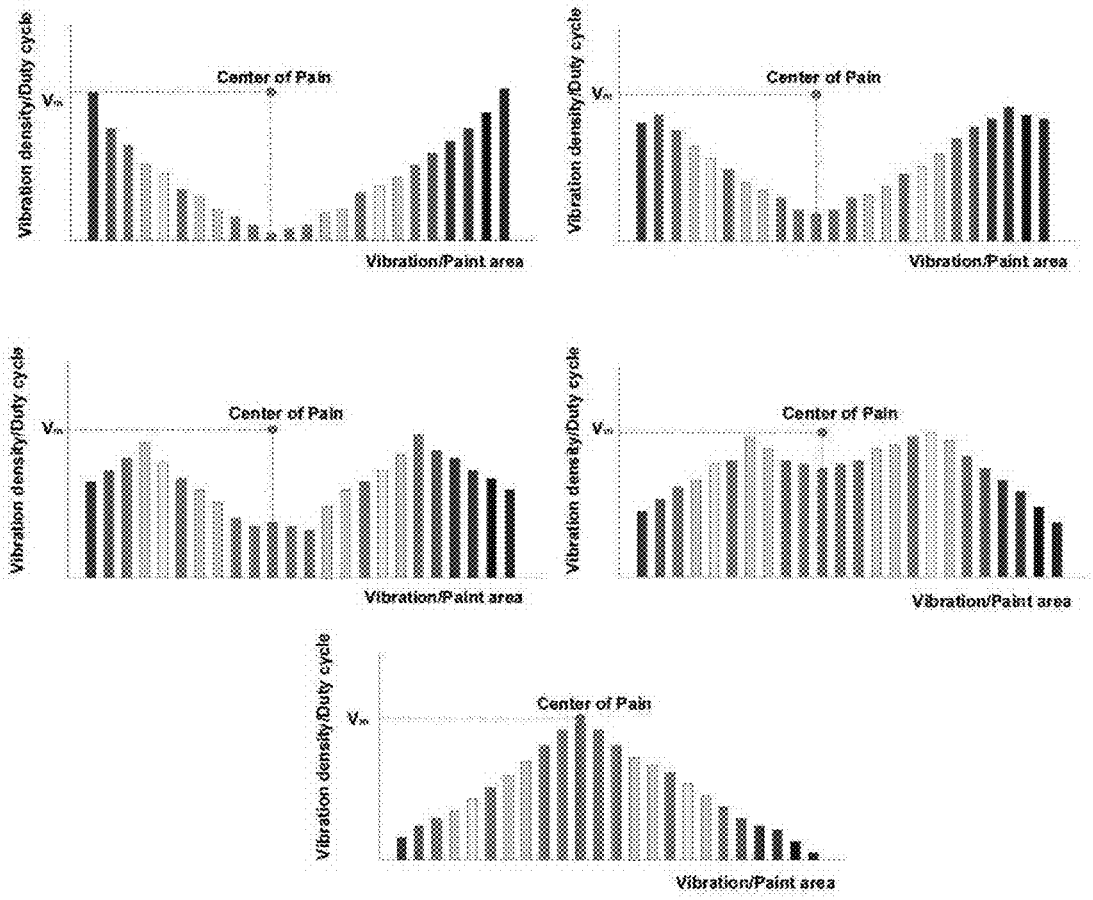
FIG. 12 shows the pre-programmed vibration for a PVSNS system starring from the no pain and edema area and slowing moving towards the pain and edema area.

FIG. 12 shows the vibration intensity versus pain and edema area during the treatment. The high intensity vibratory stimulations start from the "no pain and edema" area and no vibration or minimized vibration is applied at the "center of pain and edema". The vibration patterns could cycle or repeat during the treatment.

Figure 13:
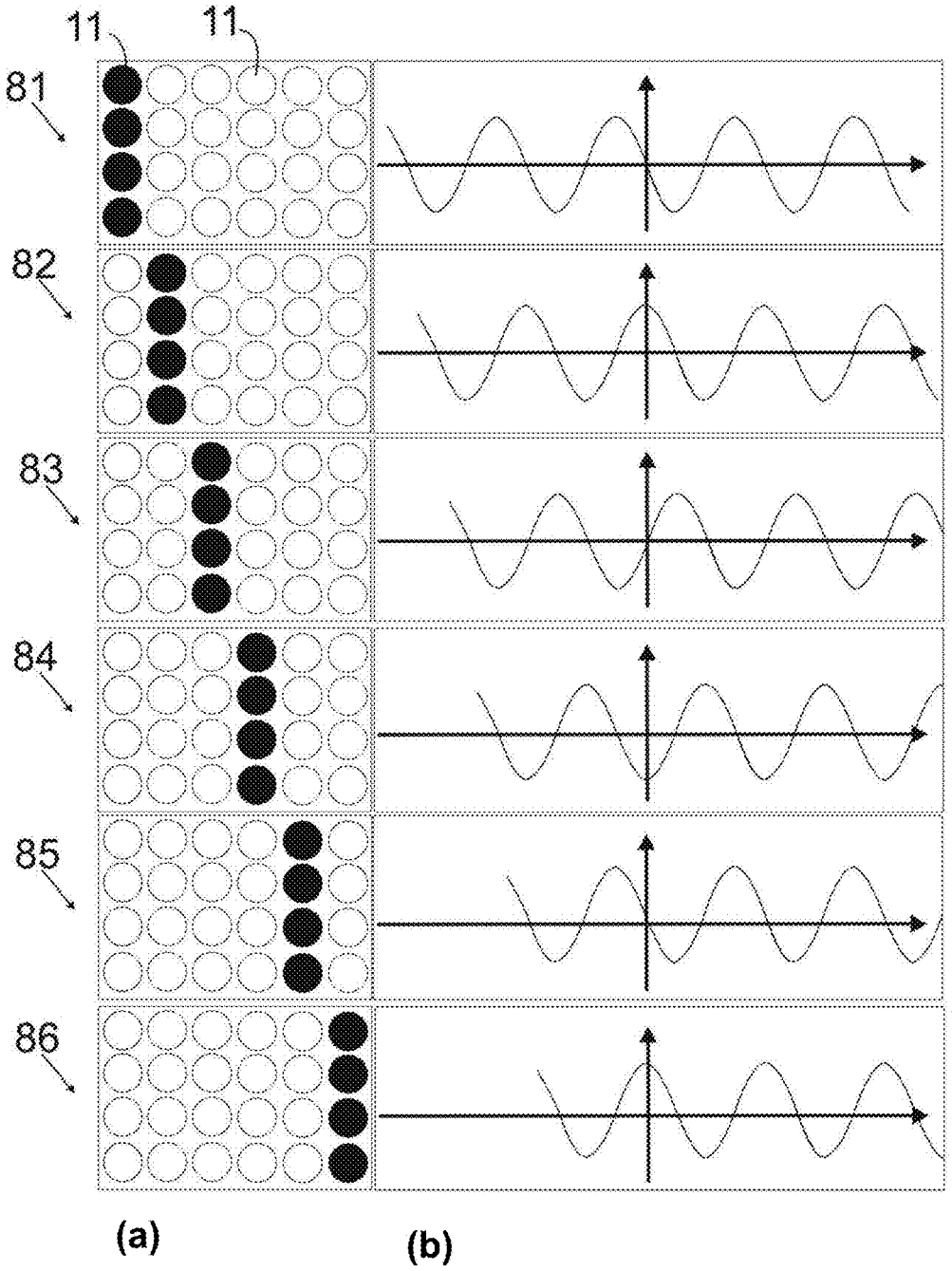
FIG. 13 shows plurality of simple vibration patterns and related intensity diagrams.
Figure 14:
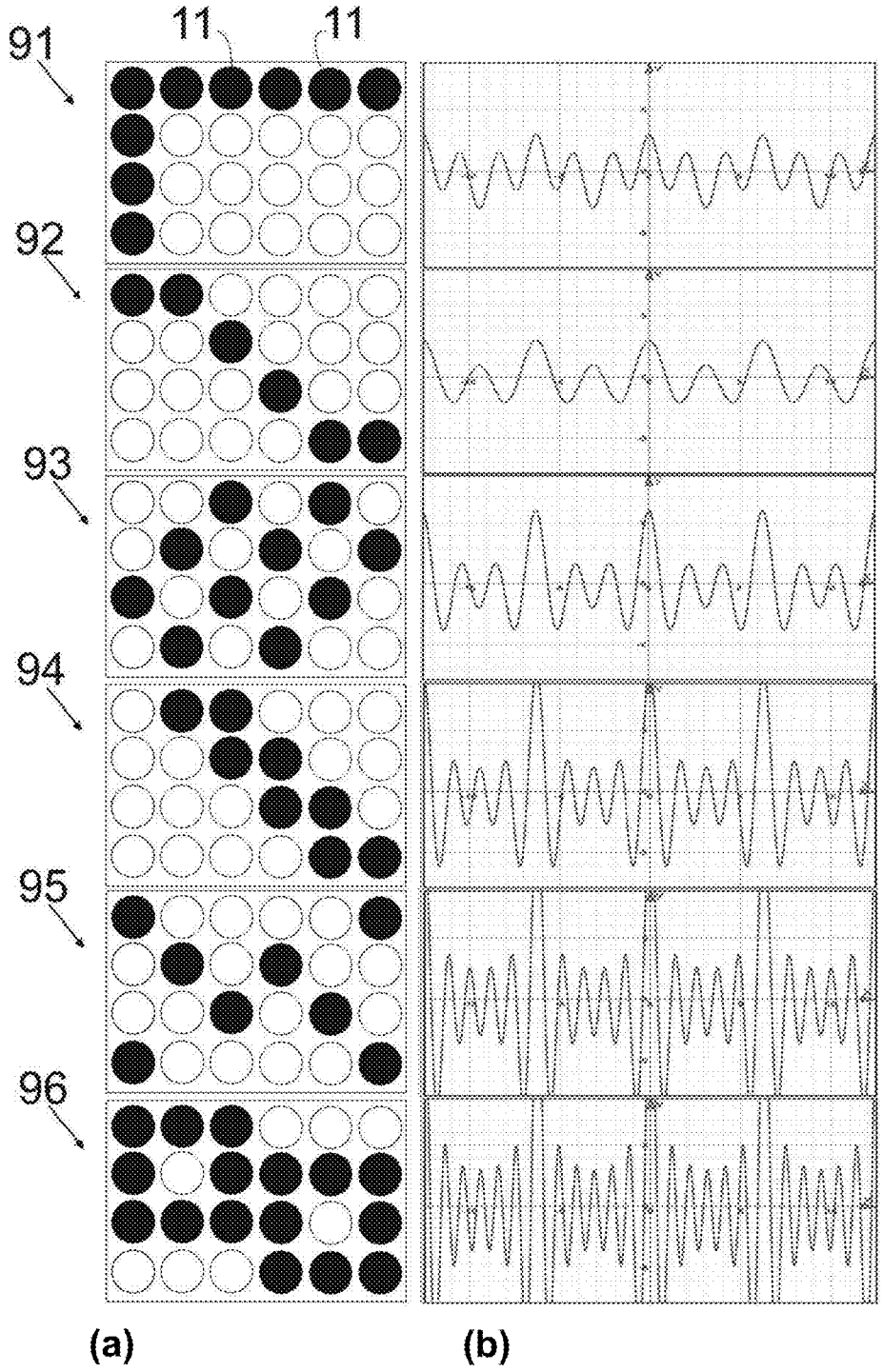
FIG. 14 shows plurality of complicated vibration patterns and related diagrams.

FIG. 13 and FIG. 14 are provided to illustrate the functionality of the present device. FIG. 13 shows a vibration pattern in an array of 4×6 vibrators. In this pattern, 4 vertical vibrators are activated at the same time, each providing a sinusoidal vibration as shown in FIG. 13(*b*). The pattern comprises of active vibrations as shown in 81 to 86. The first 4 vibrators vibrate for a set period, and the vibration shifts to the 4 vibrators in the next column. The same is repeated for all columns back and forth until the pain and/or edema is relieved. If it's is not relieved after a pre-set period, the patterns of vibration can be changed. FIG. 13(*a*) illustrates the form of the vibration that the user may feel. In this pattern, since all vibrators are coordinated, the shift in the location of the vibration does not change the form of vibration.

FIG. 14 illustrates several vibration patterns in 91-96, where the frequency and amplitude of each vibrator is slightly altered. Therefore, the user feels the sum of several vibrators each having a periodic oscillation. This sum can be represented as $f(t)=\Sigma_{n=1}^{N} a_n \sin(n\omega t+\phi)$, where N represents the number of the vibrators, $a_n$ is the amplitude of a vibrator n, ω is its frequency of vibration and ϕ is its phase difference with respect to the first vibrator, and t is time. A random number generator installed in the system provides different values for the vibration amplitude, vibration frequency, and phase shift for each of the vibrators. The certain limiting numbers are pre-programmed to limit the range of the values of each of the parameters. FIG. 14(*b*) represents the vibration intensity for the patterns 91-96 in FIG. 14(*a*). The user identifies the pattern that is more effective in reducing his/her pain and edema.

The vibration patterns used in the present invention can also be coupled with other devices. For instance, the present invention can be coupled with a game or a virtual reality system to provide vibration coupled with such system. The present invention can also receive a music in which the vibrators will operate in sync with the music beats. The present invention can also be coupled with a motor enhancing device to indicate certain movement or reactions required by a user. The present invention can also be coupled with PC or mobile phones to provide tactile communications through an app on PC or smart phones.

Figure 15:
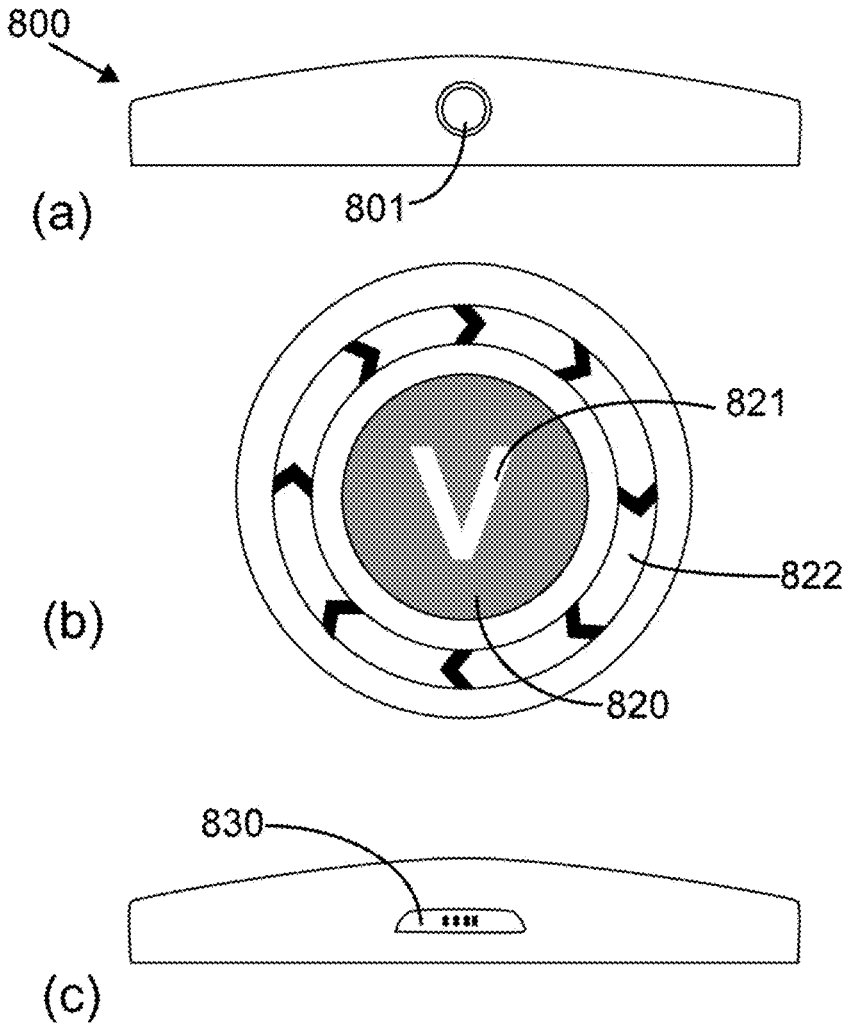
FIG. 15 shows the housing that is present in the various embodiments that are used in the present invention.

The various embodiments of the present invention are contained in a housing 800, shown in FIG. 15. A side view of the housing is shown in FIG. 15(*a*) wherein the button 801 for pattern selection is shown. The top of the housing shown in FIG. 15(*b*) shows a push button 820 for used for turning the device ON/OFF. A status light 821 is located on the push button 820 which is capable of indicating the various statuses as necessary by lighting up with different colors, such as when the device is ON/OFF or charging. Furthermore, the status light 821 can also indicate when the battery is running low or fully charged. A capacitance touch sensor which functions as a knob 822 can be used by a user to select duty cycles, patterns and frequencies of operation. The side view in FIG. 15(*c*) shows a micro USB charger 830 present on the housing, which will be used to charge the battery of the housing.

Typical usage scenario of the present invention involves a user pressing the button 820 of the housing ON, the housing will then connect with the app found in the user's smart phone. When the app is connected the user is able to select the duty cycles, patterns and frequencies for the housing. Additionally, users will be able to receive information on their mobile device when the battery of the housing 800 is running low.

An alternative usage scenario involves a user turning the housing 800 ON by pressing the ON/OFF button 820, and then using the knob or capacitance touch sensor 822 change the duty cycle for the housing 800. The button on the side 801 can then be used to change the patterns of stimulation that are to be used.

Figure 16:
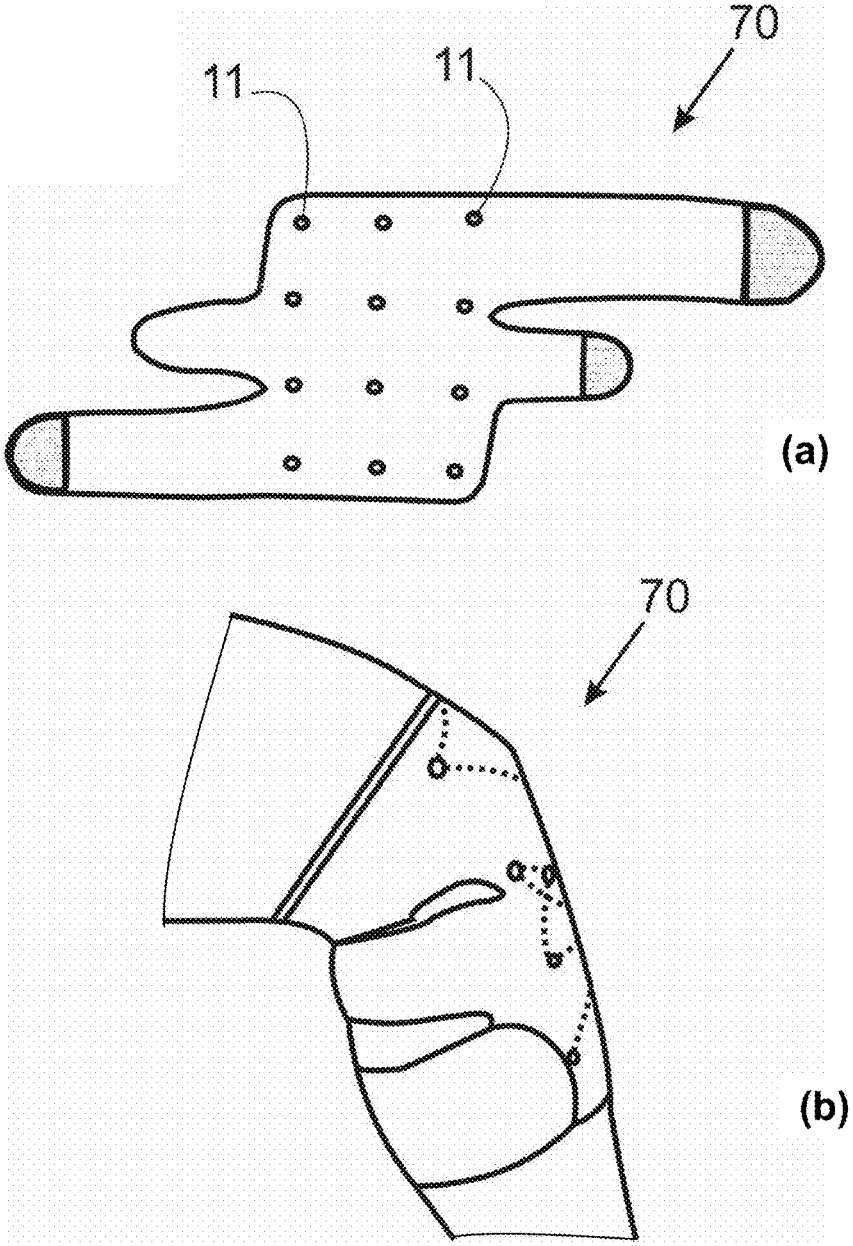
FIG. 16 shows a PVSNS knee pad: (a) PVSNS knee pad with small vibrators, (b) PVSNS knee pad worn by a user; (c) an embodiment of a PVSNS knee wrap (brace)
Figure 16:
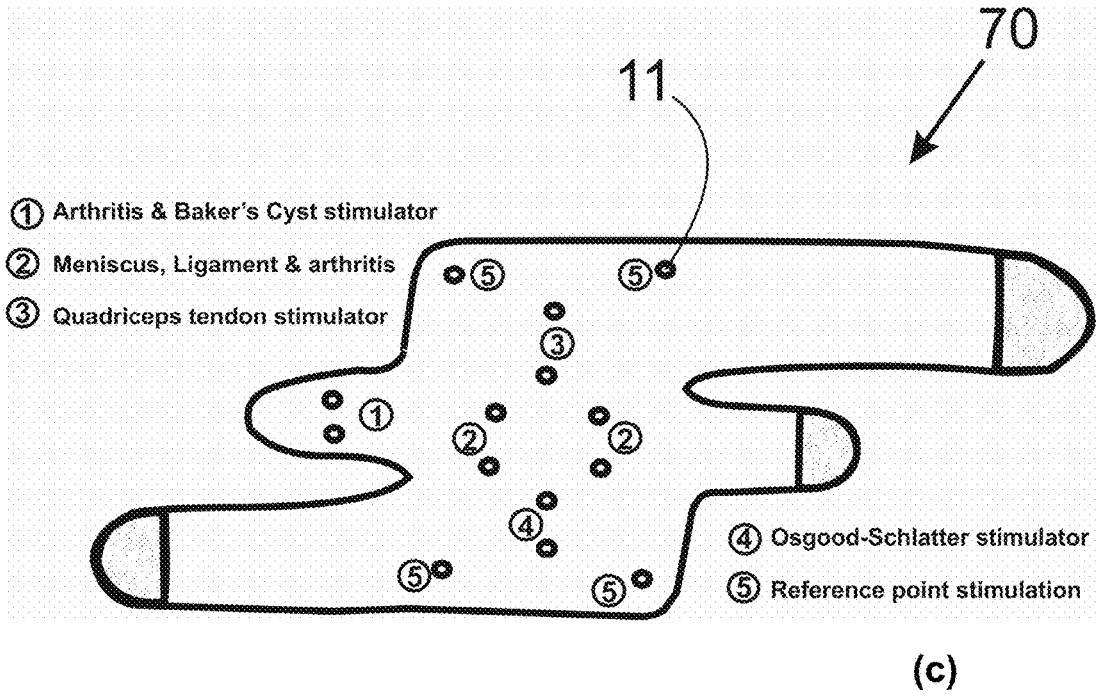

Another embodiment of the present invention is shown in FIG. 16 (*a-c*) as smart knee pad 70 with small vibrators 11. The small vibrators 11 vibrate at small amplitudes, resulting in minimal discomfort to the user. Sensors can measure heat, or a sensor array of pressure sensor arranged linearly can be used to detect pressure and thus swelling in the knee joint. A wide range of patters can be applied by a user to obtain the pattern that best relieves the pain and edema. FIG. 16 (*c*) shows another embodiment for the smart knee wrap(brace) 70 with small vibrators 11 in different location to stimulate different nerves.

Figure 17:
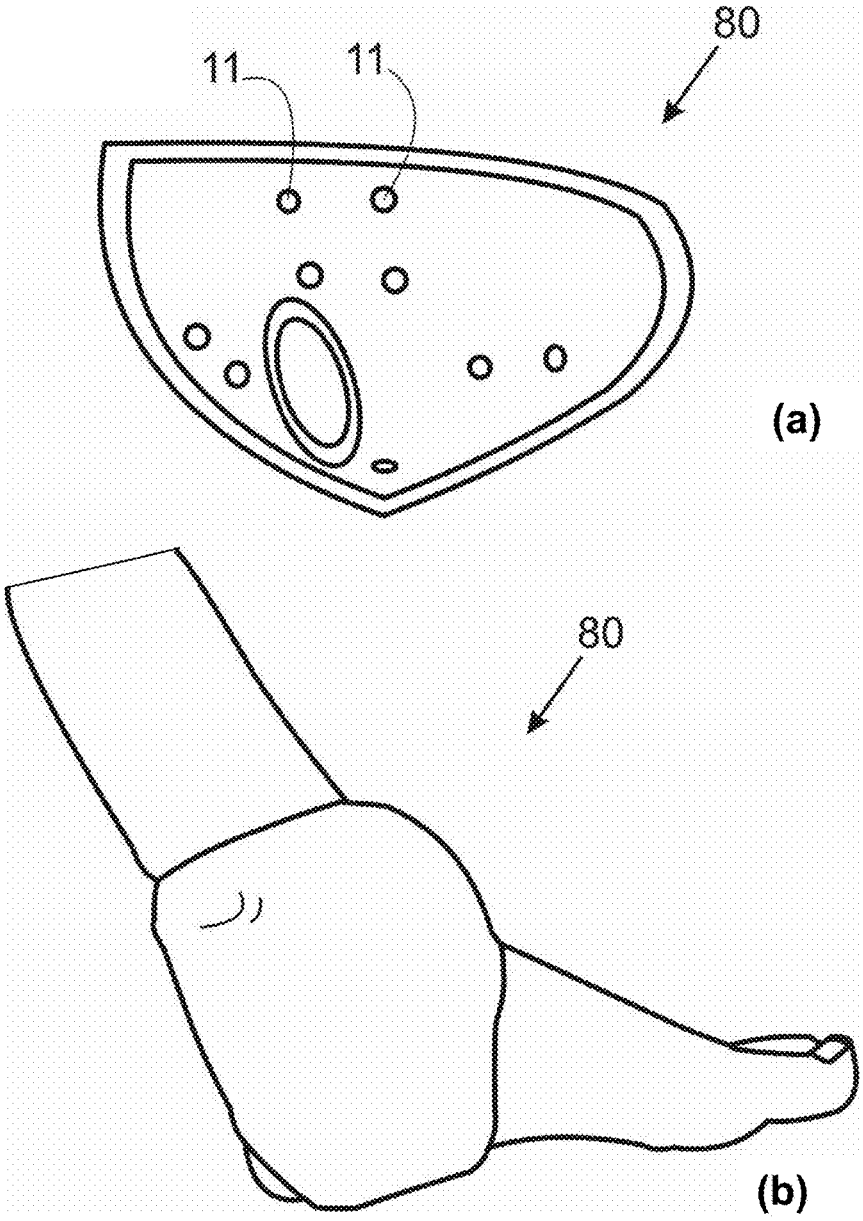
FIG. 17 shows a PVSNS ankle brace: (a) PVSNS ankle brace with small vibrators, (b) PVSNS ankle brace worn by a user.

Another embodiment of the present invention is shown in FIG. 17 (*a-b*) as smart ankle brace 80 with small vibrators 11. A wide range of patterns can be applied by a user to obtain the pattern that best relieves the pain and edema. A sensor array placed in the ankle brace can be used to measure swelling of the ankle. Because the device is light and portable, it can be used anywhere and anytime, even when the user is asleep.

Figure 18:
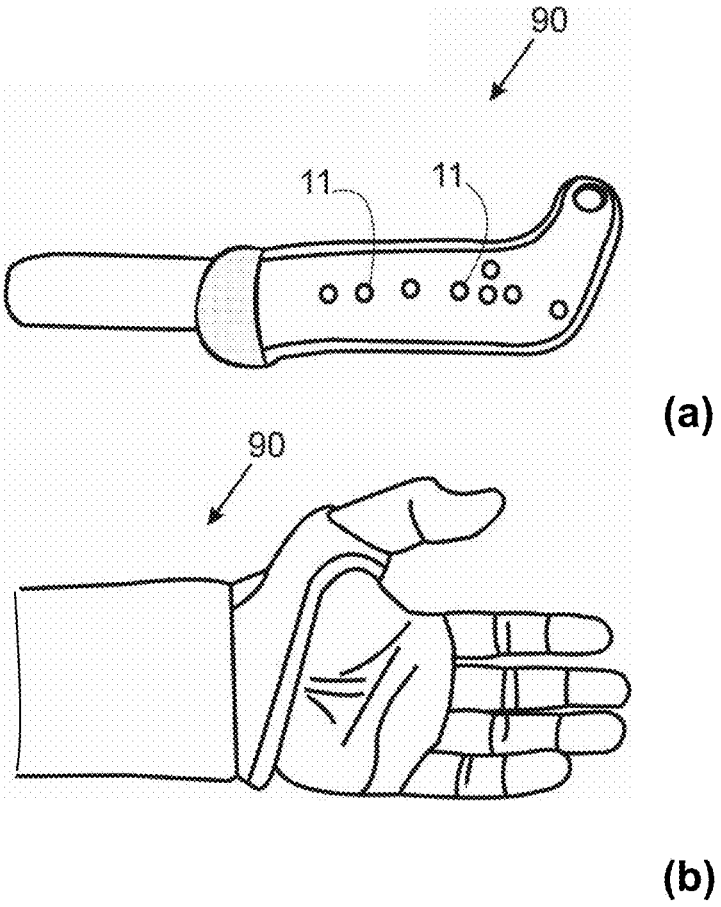
FIG. 18 shows a PVSNS wrist pad: (a) PVSNS wrist pad with small vibrators, (b) PVSNS wrist pad worn by a user, (c) an embodiment of a PVSNS wrist wrap (brace)
Figure 18:
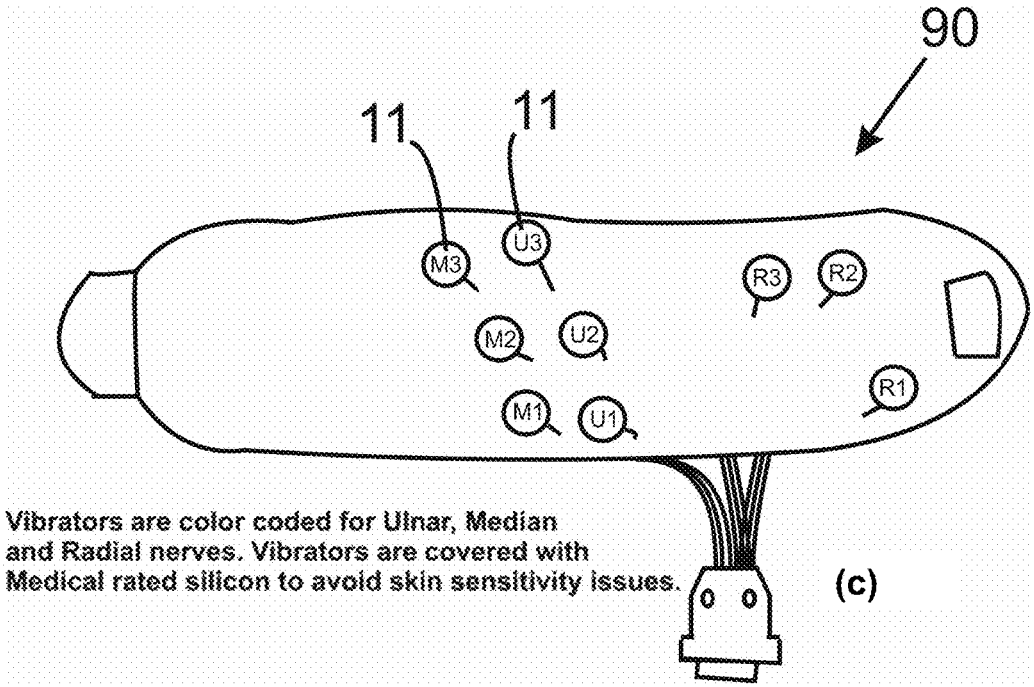

Another embodiment of the present invention is shown in FIG. 18 (*a-c*) as smart wrist wrap (brace) 90 with small vibrators 11 and sensor arrays. Again, a wide range of patterns can be applied by a user to obtain the pattern that best relieves the pain and edema. Then that pattern is selected for future use. The sensor arrays can be used to detect changes in movement of the wrist joint, or pressure sensors can be used to detect any changes in swelling.

Figure 19:
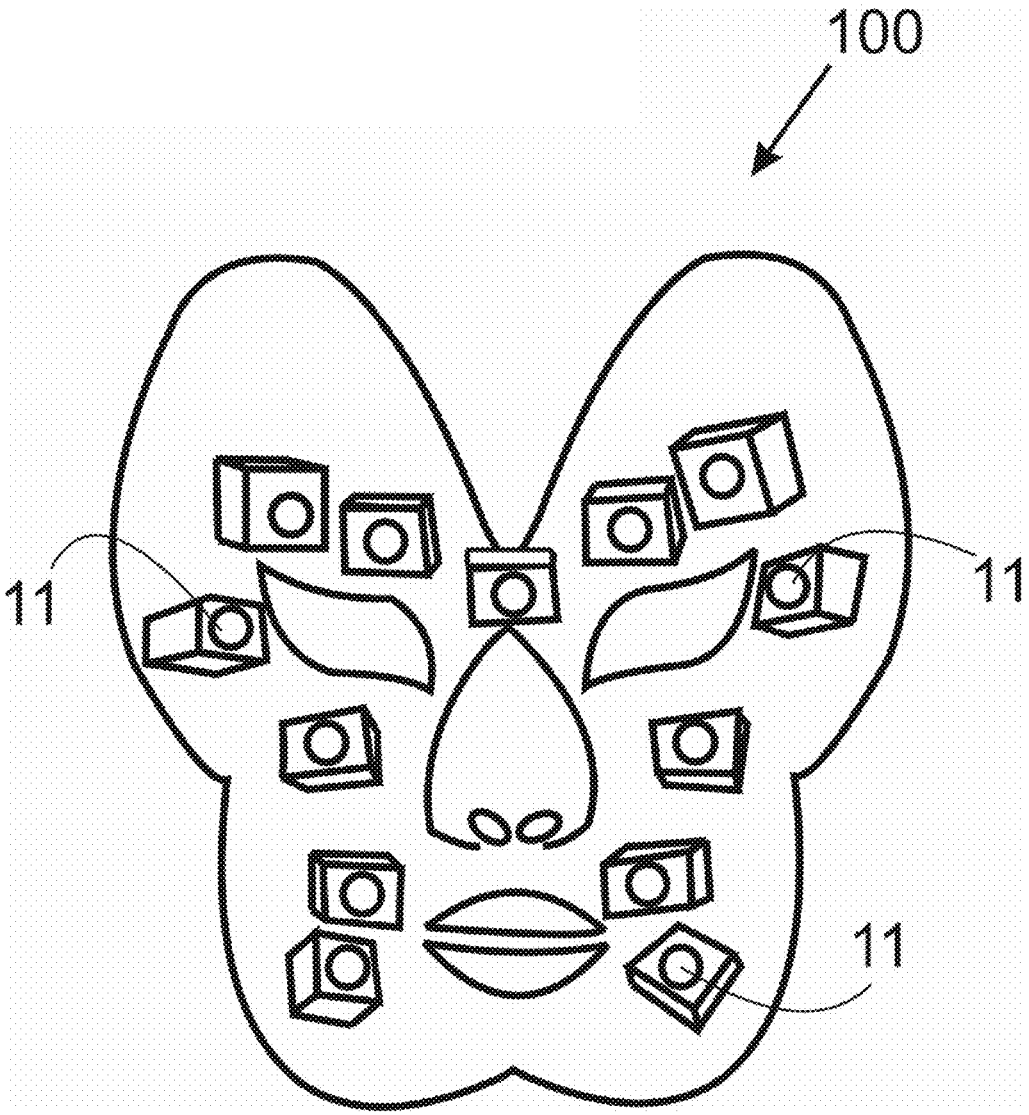
FIG. 19 shows PVSNS facial mask with small vibrators.

Another embodiment of the present invention is shown in FIG. 19 as smart facial mask 100 with small vibrators 11. By finding the pattern that best fits a user, a relaxing facial vibration is generated. Vibratory stimulations could be applied to Temporal, Zygomatic, Buccal and Mandibular facial nerves.

Figure 20:
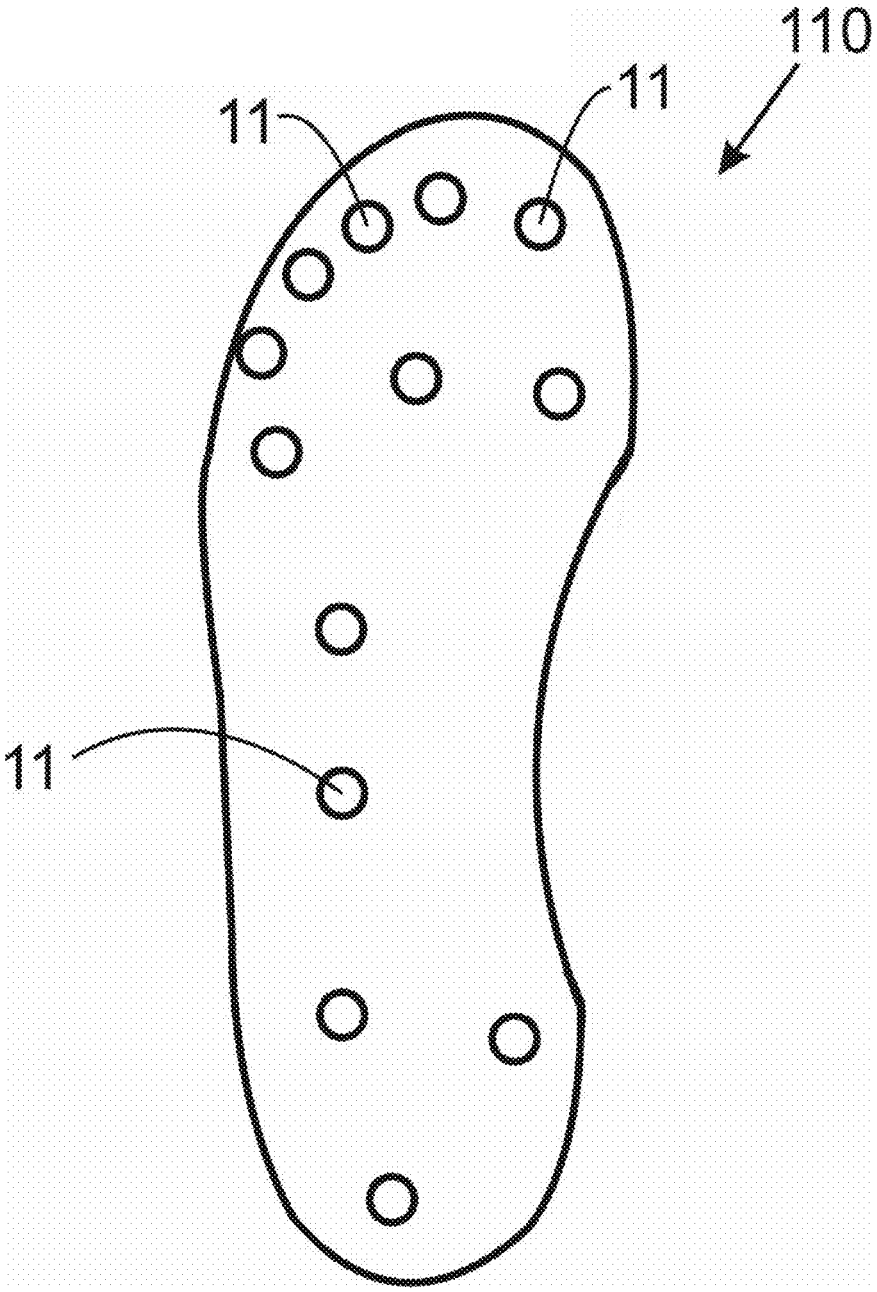
FIG. 20 shows PVSNS insole with small vibrators.

Another embodiment of the present invention is shown in FIG. 20 as smart insole 110 with small vibrators 11. Because the PVSNS insole 110 is compact in design it can be fitted in any kind of shoes. Walking with PVSNS insole 110 can reduce foot pain and edema and allow for long hours of standing, walks or hiking.

Figure 21:
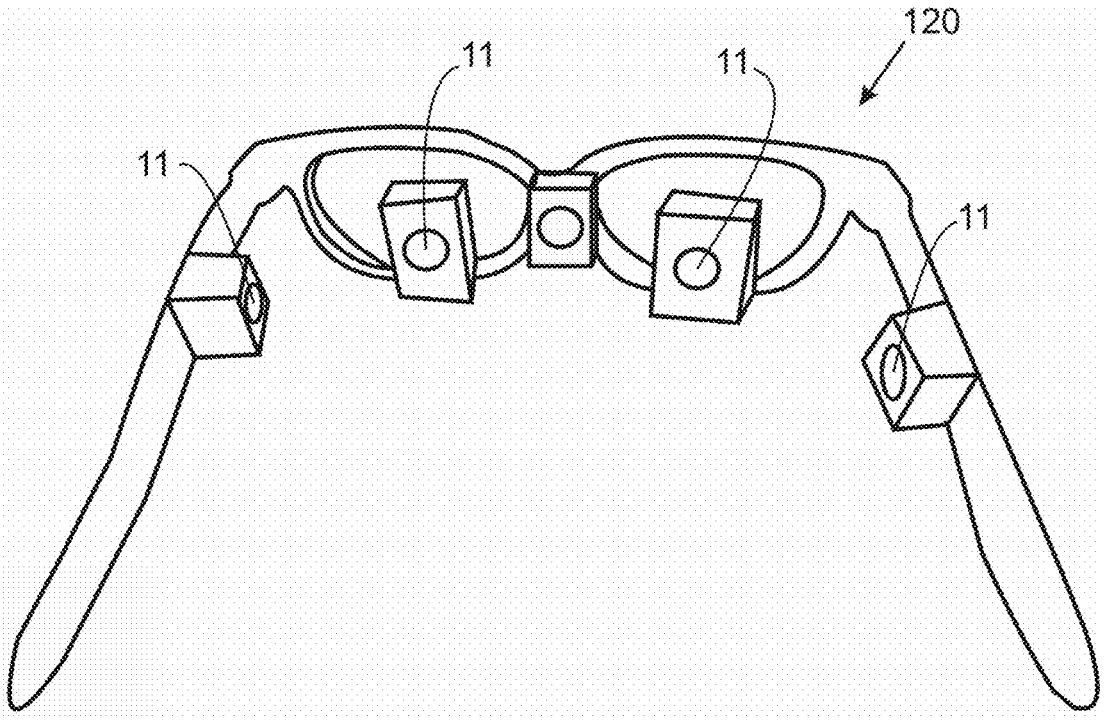
FIG. 21 shows PVSNS glasses with small vibrators for eyes and temple stimulation.

Another embodiment of the present invention is shown in FIG. 21 as smart glasses 120 with small vibrators 11. The PVSNS glasses 120 can also relieve certain types of headaches. The PVSNS glasses can also have an added extension extending downwards from the temple of the glasses. The extension has vibratory and sensory pads 11 added to it so that the vibratory pads stimulate the trigeminal nerve and help alleviate pain and edema in the temporomandibular joint (TMJ).

The present invention also has an embodiment that is designed to massage the neck and shoulders of a user. The body of this embodiment can be divided into two main parts, a neck brace which wraps around a user's neck and set of overhanging shoulder pads that are placed on the shoulders. Vibratory pads 11 are placed throughout to stimulate mainly the cervical plexus and the axillary nerves on each side of the neck and shoulder. This embodiment of the present invention thereby stimulates and helps relieve pain and edema in the neck and shoulder area and can possible reduce headaches caused by neck tension.

Figure 22:
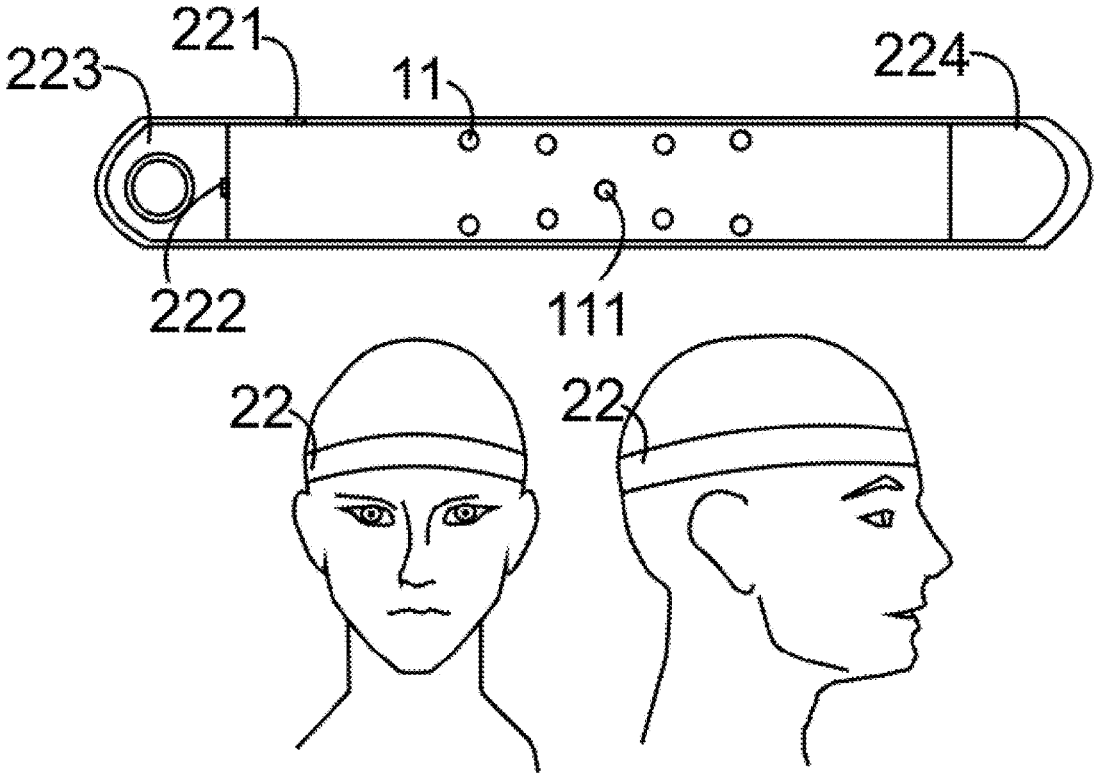
FIG. 22 shows a PVSNS headband as is worn by a user.

Yet another embodiment of the present invention is shown in FIG. 22 as a smart headband 22. Vibratory pads 11 are aligned in two parallel lines across the surface of the headband 22, a single vibratory pad 111 is located in the center of headband to which will be placed on the middle of the forehead. Two Velcro straps on either end of the headband 22 serve to keep it in place, once the headband 22 is placed on the forehead. The vibratory pads 11 are located such that they stimulate supraorbital and supratrochlear nerves. Accordingly, this headband 22 embodiment of the present invention allows for headache relief of users when wearing this embodiment of present invention.

The present invention also envisages the following embodiments where the Programmable Vibration and sensory Mesh (using miniature DC motors as vibration nodes in a programmable mesh) is used to stimulate or massage human body parts by vibration with desired or specific patterns in forms of (a) wearable objects such as neck pad, belt, shirt, shorts, pants, gloves, socks, shoes, therapeutic arm and calf band, as well as toys for adult and children; and (b) mattress (pressure wound), pillow, cushion and blanket.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A programmable vibratory sensory neural stimulation (PVSNS) system for applying vibration to a desired region of a human body comprising:

a) a plurality of vibratory stimulators installed in and throughout a flexible material forming a vibration mesh to be placed on said desired region of said human body;

b) a programmable control unit (PCU) connected by wire or wirelessly to each of said vibratory stimulators, said vibratory stimulators being miniature vibration disks;

c) a plurality of sensors installed inside the vibration mesh to collect biomechanical data from said desired region of the human body, wherein said biomechanical data comprises motion, acceleration, angular movement, orientation, and temperature;

d) a set of programs for operation of the PCU to control vibration frequency, amplitude, and period of each of the miniature vibration disks, wherein each program of the set of programs provides a predefined pattern of vibration, and wherein a set of the biomechanical data is generated for each applied pattern of the predefined patterns;

e) a biomechanical database stored in a computer and being populated by the biomechanical data collected by the sensors after application of each of the predefined patterns of vibration; and f) an algorithm to analyze and rank said patterns of vibration according to a ranking factor, wherein said ranking factor being any one of motion, acceleration, angular movement, orientation, and temperature, whereby a user can choose a pattern of vibration of the predefined patterns that has a higher ranking factor;

wherein each said vibration disks further having a pressure sensor to be identified by pressing said vibration disks, whereby a user commands the system to activate said programs starting from said pressed vibration disk.

2. The programmable vibratory sensory neural stimulation (PVSNS) system of claim 1, wherein said system ranks said patterns of vibration according to a higher to lower ranking factor scale for said biomechanical data.

3. The programmable sensory vibratory neural stimulation (PVSNS) system of claim 1, wherein said predefined patterns of vibration comprises a vibration defined by $\Sigma_{n=1}^{N} a_n \sin(n\omega t+\phi)$, where N represents number of vibrators, $a_n$ is amplitude of vibrator n, ω is its frequency of vibration, and ϕ is a phase difference, and wherein numeric value of N, $a_n$, n, ω, and ϕ are predefined or set by a user.

4. The programmable vibratory sensory neural stimulation (PVSNS) system of claim 1, wherein said system communicates with a user by a user interface, wherein said user interface being selected from the group consisting of (i) a software which is installed on a personal computer, (ii) an application which is installed on an android mobile, (iii) an application which is installed on an iPhone, and (iv) a handheld device designed for a specific program.

5. The programmable vibratory sensory neural stimulation (PVSNS) system of claim 1, wherein said PCU comprising:

a) a microcontroller responsible for gathering data of all said miniature vibration disks and analyzing said data and sending a command to the miniature vibration disks;

b) a memory to store said data of all said miniature vibration disks; and c) a wireless communication unit to communicate with a personal computer or a mobile device.

6. The programmable vibratory sensory neural stimulation (PVSNS) system of claim 1, wherein said PCU further having an internet connection.

7. The programmable vibratory sensory neural stimulation (PVSNS) system of claim 1, wherein said biomechanical database being stored in a cloud storage on internet.

8. The programmable vibratory sensory neural stimulation (PVSNS) system of claim 1, wherein said system being installed in a cap adapted to be worn by a user.

9. The programmable vibratory sensory neural stimulation (PVSNS) system of claim 1, wherein said system being installed in a knee pad adapted to be worn by a user.

10. The programmable vibratory sensory neural stimulation (PVSNS) system of claim 1, wherein said system being installed in an ankle brace adapted to be worn by a user.

11. The programmable vibratory sensory neural stimulation (PVSNS) system of claim 1, wherein said system being installed in a wrist wrap adapted to be worn by a user.

12. The programmable vibratory sensory neural stimulation (PVSNS) system of claim 1, wherein said system being installed in an insole of a shoe adapted to be worn by a user.

13. A method for relieving pain and edema comprising steps of:

a) installing a plurality of miniature vibration disks in and throughout a flexible material forming a vibration mesh to be placed on a desired region of a human body;

b) connecting a programmable control unit (PCU) by wire or wirelessly to each of said miniature vibration disks;

c) installing a plurality of sensors inside said vibration mesh to collect biomechanical data from said desired region of said human body, wherein said biomechanical data comprises motion, acceleration, angular movement, orientation, and temperature;

d) providing a set of programs for the operation of the PCU to control vibration frequency, amplitude, and period of each of said miniature vibration disks, wherein each program providing a predefined pattern of vibration, and wherein a set of biomechanical data being generated for each applied pattern of the predetermined patterns;

e) generating and storing a biomechanical database in a computer, wherein said database being populated by the biomechanical data collected by said sensors after application of each said predefined pattern of vibration; and f) analyzing and ranking said patterns of vibration by an algorithm according to a ranking factor, wherein said ranking factor being any one of motion, acceleration, angular movement, orientation, and temperature, whereby a user can choose a pattern of vibration of the predetermined patterns that has a higher ranking factor;

wherein each of said vibration disks further having a pressure sensor to be identified by pressing said vibration disk, whereby a user activates said vibration disk by pressing the vibration disk or activates said programs starting from said pressed vibration disk.

14. The method for relieving pain and edema of claim 13, wherein said method ranks said patterns of vibration according to a higher to lower ranking factor scale for said biomechanical data.

15. The method for relieving pain and edema of claim 13, wherein said predefined patterns of vibration comprises a vibration defined by $\Sigma_{n=1}^{N} a_n \sin(n\omega t+\phi)$, where N represents number of vibration disks, $a_n$ is amplitude of vibration disks n, $\omega$ is its frequency of vibration, and $\phi$ is a phase difference, and wherein a numeric value of N, $a_n$, n, $\omega$, and $\phi$ are predefined or set by a user.

16. The method for relieving pain and edema of claim 13, wherein said PCU comprising:

a) a microcontroller responsible for gathering data of all said miniature vibration disks and analyzing said data and sending a command to the miniature vibration disks;

b) a memory to store said data of all said miniature vibration disks; and c) a wireless communication unit to communicate with a personal computer or a mobile device.

17. The method for relieving pain and edema of claim 13, wherein said biomechanical database being stored in cloud storage on internet.

18. The method for relieving pain and edema of claim 13, wherein said sensors associate a level of pain and edema based on a change in range of motion and acceleration.

* * * * *